US009378671B2

(12) United States Patent
Kline et al.

(10) Patent No.: US 9,378,671 B2
(45) Date of Patent: Jun. 28, 2016

(54) LARGE SCALE LED DISPLAY

(71) Applicant: ADVANCE DISPLAY TECHNOLOGIES, INC., Englewood, CO (US)

(72) Inventors: Daniel S. Kline, Encinitas, CA (US); Matthew W. Shankle, Greenwood Village, CO (US); David F. Cox, Escondido, CA (US); James C. Lee, San Diego, CA (US); Sam R. Sarcia, San Diego, CA (US)

(73) Assignee: ADTI Media LLC, Temecula, CA (US)

( * ) Notice: Subject to any disclaimer, the term of this patent is extended or adjusted under 35 U.S.C. 154(b) by 275 days.

(21) Appl. No.: 14/178,023

(22) Filed: Feb. 11, 2014

(65) Prior Publication Data

US 2014/0225808 A1 Aug. 14, 2014

Related U.S. Application Data

(63) Continuation of application No. 12/273,884, filed on Nov. 19, 2008, now Pat. No. 8,648,774, which is a continuation-in-part of application No. 12/001,315, filed on Dec. 11, 2007, now Pat. No. 8,599,108.

(51) Int. Cl.

| | |
|---|---|
| ***G09G 3/32*** | (2016.01) |
| ***G09F 9/33*** | (2006.01) |
| ***G09F 9/302*** | (2006.01) |

(52) U.S. Cl.

CPC ..... *G09G 3/32* (2013.01); *G09F 9/3026* (2013.01); *G09F 9/33* (2013.01); *G09G 2360/04* (2013.01)

(58) Field of Classification Search

CPC ..... G09G 3/32; G09G 2360/04; G09F 9/33; G09F 9/3026

USPC ..... 362/249.06, 249.14, 249.15

See application file for complete search history.

(56) References Cited

U.S. PATENT DOCUMENTS

| | | | |
|---|---|---|---|
| 4,268,821 | A | 5/1981 | DeSmet |
| 4,782,336 | A | 11/1988 | Bailey |

(Continued)

FOREIGN PATENT DOCUMENTS

| | | | |
|---|---|---|---|
| CN | 1438515 | A | 8/2003 |
| EP | 1550947 | A2 | 7/2005 |

(Continued)

OTHER PUBLICATIONS

European Patent Office, Communication with Extended Search Report, in application No. 08859399.1, dated Apr. 27, 2011.

(Continued)

*Primary Examiner* — Laura Tso

(74) *Attorney, Agent, or Firm* — Jerry R. Potts; James R. McDaniel

(57) ABSTRACT

A large scale LED display has a number of display panels each having a cable and spacer support structure for a number of LED modules. Adjacent display panels are connected together by a number of seam links that snap onto one cable of one of the display panels and one cable of the adjacent display panel. The cables may include a number of seam link engagement members spaced along the length of the cable and onto which the seam links snap wherein each of the seam link engagement members locates an LED module on the support structure. The LED modules include top and bottom housing sections that snap together, wherein one of the housing sections includes a seat for an electrical connector. The seat locates the connector and a printed circuit assembly within the LED module.

20 Claims, 23 Drawing Sheets

(56) References Cited

U.S. PATENT DOCUMENTS

| | | | | |
|---|---|---|---|---|
| 4,833,542 | A | 5/1989 | Hara | |
| 4,887,074 | A | 12/1989 | Simon et al. | |
| 5,160,200 | A | 11/1992 | Cheselske | |
| 5,184,114 | A | 2/1993 | Brown | |
| 5,287,353 | A | 2/1994 | Buda et al. | |
| 5,317,344 | A | 5/1994 | Beaman et al. | |
| 5,406,176 | A | 4/1995 | Sugden | |
| 5,410,328 | A | 4/1995 | Yoksza et al. | |
| 5,420,482 | A | 5/1995 | Phares | |
| 5,424,925 | A | 6/1995 | Jenke et al. | |
| 5,523,769 | A | 6/1996 | Lauer et al. | |
| 5,564,819 | A | 10/1996 | Yamaguchi | |
| 5,636,303 | A | 6/1997 | Che et al. | |
| 5,882,105 | A | 3/1999 | Barlow | |
| 5,900,850 | A | 5/1999 | Bailey et al. | |
| 5,924,784 | A | 7/1999 | Chliwnyj et al. | |
| 6,009,650 | A | 1/2000 | Lamparter | |
| 6,016,038 | A | 1/2000 | Mueller et al. | |
| 6,104,414 | A | 8/2000 | Odryna et al. | |
| 6,118,426 | A | 9/2000 | Albert et al. | |
| 6,150,774 | A | 11/2000 | Mueller et al. | |
| 6,211,626 | B1 | 4/2001 | Lys et al. | |
| 6,269,565 | B1 | 8/2001 | Inbar et al. | |
| 6,302,562 | B1 * | 10/2001 | Wu | F21S 4/10 362/249.14 |
| 6,309,087 | B1 * | 10/2001 | Huang | F21S 4/10 362/249.15 |
| 6,340,957 | B1 | 1/2002 | Adler | |
| 6,362,801 | B1 * | 3/2002 | Yuhara | G09F 9/3026 345/82 |
| 6,394,623 | B1 | 5/2002 | Tsui | |
| 6,400,101 | B1 | 6/2002 | Biebl | |
| 6,435,459 | B1 | 8/2002 | Sanderson et al. | |
| 6,461,008 | B1 | 10/2002 | Pederson | |
| 6,498,672 | B2 | 12/2002 | Saitoh | |
| 6,519,395 | B1 | 2/2003 | Bevan et al. | |
| 6,558,021 | B2 | 5/2003 | Wu et al. | |
| 6,608,453 | B2 | 8/2003 | Morgan et al. | |
| 6,737,983 | B1 | 5/2004 | Temple | |
| 6,777,891 | B2 | 8/2004 | Lys et al. | |
| 6,788,011 | B2 | 9/2004 | Mueller et al. | |
| 6,806,659 | B1 | 10/2004 | Mueller et al. | |
| 6,998,650 | B1 | 2/2006 | Wu | |
| 7,064,673 | B1 | 6/2006 | Bonham | |
| 7,071,620 | B2 | 7/2006 | Devos et al. | |
| 7,221,104 | B2 | 5/2007 | Lys et al. | |
| 7,253,566 | B2 | 8/2007 | Lys et al. | |
| 7,295,199 | B2 | 11/2007 | Foo et al. | |
| 7,319,408 | B2 | 1/2008 | Temple | |
| 7,616,635 | B2 | 11/2009 | Slaight | |
| 8,021,020 | B2 * | 9/2011 | Costello | D03D 9/00 362/249.06 |
| 8,637,882 | B2 * | 1/2014 | Stoyan | F21S 2/005 257/98 |
| 8,845,130 | B2 * | 9/2014 | Gingrich, III | F21S 2/005 257/99 |
| 2002/0110000 | A1 | 8/2002 | Marcus | |
| 2002/0122309 | A1 | 9/2002 | Abdelhafex et al. | |
| 2003/0051098 | A1 | 3/2003 | Brant | |
| 2003/0058191 | A1 | 3/2003 | Yuhara et al. | |
| 2003/0112204 | A1 | 6/2003 | Petttersen | |
| 2003/0117347 | A1 | 6/2003 | Hunter et al. | |
| 2003/0146882 | A1 | 8/2003 | Ogino et al. | |
| 2004/0008155 | A1 | 1/2004 | Cok | |
| 2004/0080938 | A1 | 4/2004 | Holman et al. | |
| 2004/0095763 | A1 | 5/2004 | Guerrieri et al. | |
| 2004/0222941 | A1 | 11/2004 | Wong | |
| 2005/0052373 | A1 | 3/2005 | Devos | |
| 2005/0052374 | A1 | 3/2005 | Devos et al. | |
| 2005/0052375 | A1 | 3/2005 | Devos et al. | |
| 2005/0093768 | A1 | 5/2005 | Devos et al. | |
| 2005/0111231 | A1 | 5/2005 | Crodian | |
| 2005/0168424 | A1 | 8/2005 | Nakamoto et al. | |
| 2005/0259034 | A1 | 11/2005 | Harada et al. | |
| 2005/0264471 | A1 | 12/2005 | Yamazaki | |
| 2006/0022214 | A1 | 2/2006 | Morgan et al. | |
| 2006/0039142 | A1 | 2/2006 | Temple | |
| 2006/0132048 | A1 | 6/2006 | Popovich | |
| 2006/0227003 | A1 | 10/2006 | Ven | |
| 2006/0241878 | A1 | 10/2006 | Jing | |
| 2006/0256033 | A1 | 11/2006 | Chan | |
| 2007/0015396 | A1 | 1/2007 | Mrakovich et al. | |
| 2007/0041190 | A1 | 2/2007 | Chou | |
| 2007/0041220 | A1 | 2/2007 | Lynch | |
| 2007/0115666 | A1 | 5/2007 | Thomas et al. | |
| 2007/0188427 | A1 | 8/2007 | Lys | |
| 2007/0211184 | A1 | 9/2007 | Erchak et al. | |
| 2007/0241988 | A1 | 10/2007 | Zerphy | |
| 2007/0279314 | A1 | 12/2007 | Brown | |
| 2008/0123367 | A1 | 5/2008 | Pan et al. | |
| 2008/0244944 | A1 | 10/2008 | Nall et al. | |
| 2009/0027303 | A1 | 1/2009 | Arthur | |
| 2009/0096711 | A1 | 4/2009 | Jang | |
| 2009/0121988 | A1 | 5/2009 | Amo et al. | |
| 2009/0146917 | A1 | 6/2009 | Kharrati et al. | |
| 2009/0146918 | A1 | 6/2009 | Kline et al. | |
| 2009/0146919 | A1 | 6/2009 | Kline et al. | |
| 2009/0146931 | A1 | 6/2009 | Kharrati et al. | |
| 2009/0147028 | A1 | 6/2009 | Sefton | |
| 2009/0153756 | A1 | 6/2009 | Roberts | |
| 2010/0026614 | A1 | 2/2010 | Blackwell | |
| 2011/0215992 | A1 | 9/2011 | Kline et al. | |
| 2011/0221662 | A1 | 9/2011 | Kline et al. | |
| 2013/0294079 | A1 * | 11/2013 | Tran | F21S 8/046 362/249.15 |

FOREIGN PATENT DOCUMENTS

| | | | |
|---|---|---|---|
| GB | 2143983 | A | 2/1985 |
| GB | 2240686 | A | 7/1991 |
| JP | H01113280 | U | 7/1989 |
| JP | H01113285 | U | 7/1989 |
| JP | H0295109 | A | 4/1990 |
| JP | H02278282 | A | 11/1990 |
| JP | H04186276 | A | 7/1992 |
| JP | 1994040992 | | 5/1994 |
| JP | H1195715 | A | 4/1999 |
| JP | 2000012906 | A | 1/2000 |
| JP | 2000221934 | | 8/2000 |
| JP | 2001282187 | | 10/2001 |
| JP | 2003092195 | | 3/2003 |
| JP | 2003140571 | | 5/2003 |
| JP | 2003280624 | | 10/2003 |
| JP | 2006005830 | | 1/2006 |
| JP | 2007298753 | | 11/2007 |
| JP | 2008052238 | A | 3/2008 |
| WO | 2007131344 | A1 | 11/2007 |
| WO | 2007138494 | A1 | 12/2007 |
| WO | 2009076116 | A1 | 6/2009 |
| WO | 2010059431 | A1 | 5/2010 |

OTHER PUBLICATIONS

Extended European Search Report dated Dec. 7, 2010, Application No. EP-08858504, Supplementary European Search Report and European Search Opinion.

Extended European Search Report dated Dec. 7, 2010, Application No. EP-08859575, Supplementary European Search Report and European Search Opinion.

International Bureau, International Preliminary Report on Patentability and Written Opinion of the International Searching Authority, dated Jun. 24, 2010, International Application No. PCT/US2008/085320.

International Bureau, International Preliminary Report on Patentability and Written Opinion of the International Searching Authority, dated Jun. 24, 2010, International Application No. PCT/US2008/085315.

International Bureau, International Preliminary Report on Patentability and Written Opinion of the International Searching Authority, dated Jun. 24, 2010, International Application No. PCT/US2008/085313.

(56) References Cited

OTHER PUBLICATIONS

International Bureau, International Preliminary Report on Patentability and Written Opinion of the International Searching Authority, dated Jun. 24, 2010, International Application No. PCT/US2008/085316.

International Searching Authority, International Search Report and Written Opinion of the International Searching Authority, dated Jan. 30, 2009, International Application No. PCT/US2008/85315.

International Searching Authority, International Search Report and Written Opinion of the International Searching Authority, dated Feb. 3, 2009, International Application No. PCT/US2008/85316.

International Searching Authority, International Search Report and Written Opinion of the International Searching Authority, dated Feb. 5, 2009, International Application No. PCT/US2008/85320.

International Searching Authority, International Search Report and Written Opinion of the International Searching Authority, dated Feb. 9, 2009, International Application No. PCT/US2008/85313.

European Search Report dated Jan. 27, 2010, Reference No. P91157EP00, Application No./Patent No. 05789062.6-1231 / 1784799 PCT/US2005029599.

International Searching Authority, International Search Report and Written Opinion of the International Searching Authority, International Application No. PCT/US2009/063350, Jan. 12, 2010.

Notification concerning transmittal of International Preliminary Report on Patentability (Chapter 1 of the Patent Cooperation Treaty) dated Jun. 3, 2011 in International Application No. PCT/US2009/063350; International Preliminary Report on Patentability dated May 24, 2011; and Written Opinion of the International Searching Authority.

Chinese Foreign Search Report corresponding to CN 2008801265197, Feb. 6, 2013, 4 pages.

Communication with European Search Report and Search Opinion corresponding to EP08859136, Sep. 6, 2013, 4 pages.

* cited by examiner

LARGE SCALE LED DISPLAY

CROSS-REFERENCE TO RELATED APPLICATIONS

The present application is a continuation of U.S. patent application Ser. No. 12/273,884, filed Nov. 19, 2008, U.S. Pat. No. 8,648,774, which is a continuation-in-part of U.S. patent application Ser. No. 12/001,315, filed Dec. 11, 2007, U.S. Pat. No. 8,599,108.

This application is related to U.S. patent application Ser. No. 12/001,277, filed Dec. 11, 2007; U.S. patent application Ser. No. 12/001,312, filed Dec. 11, 2007; and U.S. patent application Ser. No. 12/001,276, filed Dec. 11, 2007, U.S. Pat. No. 8,558,755.

The above-identified applications are hereby incorporated herein by reference in their entirety.

STATEMENT REGARDING FEDERALLY SPONSORED RESEARCH OR DEVELOPMENT

N/A

TECHNICAL FIELD

The present invention is directed to a large scale display and more particularly to the LED modules, segments and support structure for a large scale LED display.

BACKGROUND OF THE INVENTION

Large scale displays on the order of 10×20 ft. or 40×60 ft. are known to employ a net formed of intersecting cables to structurally support a number of pixel units as shown in U.S. Pat. No. 7,319,408. Because of its flexible nature, this net display may be supported on curved or irregular surfaces as well as flat surfaces. However, this net display is so flexible that the pixel units can twist about the cables, impairing the visibility of the pixels. Moreover, the horizontal cables of the net flex so that the pixel units become misaligned resulting in distortions in the displayed image. The pixel units of this net display include a housing for a circuit board that supports a cluster of red, green and blue LEDs wherein a potting material seals the circuit board from the environment. U.S. Pat. No. 5,410,328 to Yoksza et al. shows similar pixel modules for a large scale LED display wherein each module is individually removable from the display by removing a few screws or twisting the module. One wall of the housing of the pixel module in Yoksza et al. extends beyond the LEDs so as to provide a sunshade for the module. Another LED module for a display, as shown in U.S. Pat. No. 4,887,074 by Simon et al., uses a heat sinking potting compound in contact with the circuit board supporting the LEDs and heat spreader plates to dissipate heat from the module housing.

BRIEF SUMMARY OF THE INVENTION

In accordance with the present invention, the disadvantages of prior art large scale LED displays have been overcome. The LED display system of the present invention includes a novel support structure for a number of LED modules wherein the support structure is sufficiently flexible so that the display can conform to curved or irregular surfaces and yet the support structure has sufficient structural integrity to prevent twisting and sagging of the LED modules, preventing misalignment of the modules so that a distortion free image can be displayed.

In accordance with one feature of the present invention, the display includes a plurality of LED display panels wherein each display panel includes a plurality of LED modules mounted in a plurality of rows on a support structure that includes a plurality of parallel cables and spacers such that a LED module is spaced from an adjacent LED module in a row by a spacer mounted on a pair of adjacent cables. The LED display also includes a plurality of links, each link having a first end for snapping on a cable on the edge of one LED display panel and a second end for snapping on a cable on the edge of an adjacent LED display panel to connect the display panels together.

In accordance with another feature of the present invention, the display includes a plurality of LED display panels wherein each display panel includes at least one column of LED modules mounted on a pair of parallel cables. The display also includes a plurality of links, each link having a first end for snapping on a cable of one LED display panel and having a second end for snapping on a cable of another LED display panel to connect the panels together.

In accordance with a further feature of the present invention, the cables onto which the links snap to connect the panels together include a plurality of link engagement members that are disposed along the length of the cable wherein the links snap onto a link engagement member.

In accordance with another feature of the present invention, a LED module includes a circuit assembly having a plurality of LEDs mounted thereon and an electrical connector for connecting a cable carrying power and/or control signals to the circuit assembly. The LED module includes a housing comprising a first module housing section having a seat for locating the electrical connector within the LED module wherein the cable passes through the module; and a second module housing section having apertures through which the LEDs extend, the second housing section snapping onto the first housing section. A potting material is employed to encapsulate the circuit assembly and the electrical connector within the LED module.

In accordance with a further feature of the present invention, the seat of the first module housing section is defined by at least two spaced walls wherein the seat locates the electrical connector within the LED module and the seat has an upper surface upon which the circuit assembly rests.

In accordance with a further feature of the present invention, the second housing section includes a conically shaped seal around each aperture through which the LEDs extend.

These and other advantages and novel features of the present invention, as well as details of an illustrated embodiment thereof, will be more fully understood from the following description and drawings.

DETAILED DESCRIPTION OF THE INVENTION

Figure 1:
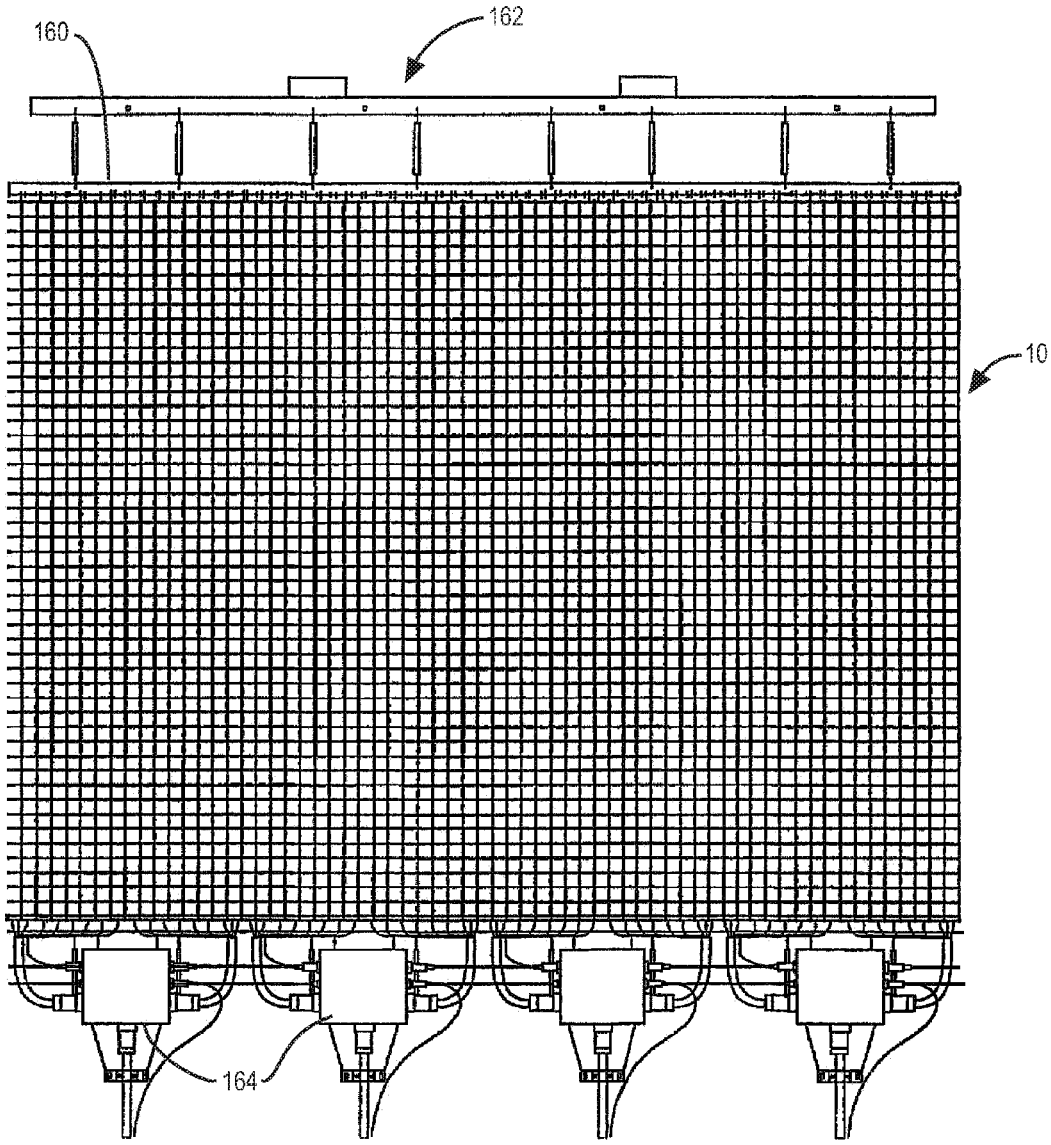
FIG. 1 is a front view of a large scale display in accordance with one embodiment of the present invention.

A large scale LED display 10 in accordance with the present invention, as shown in FIG. 1, has height by width dimensions on the order of 3 m×6 m to 24 m×32 m or approximately 10 ft.×20 ft. to 80 ft.×105 ft. However, it should be appreciated, that the present invention can be used for displays that are larger or smaller as well. A display that is approximately 24 m×32 m has 480 pixels×640 pixels or a total of 307,200 pixels. These large scale LED displays are intended for both indoor use and outdoor use. The large scale display in accordance with the present invention is extremely robust and can withstand harsh outdoor environments while providing distortion free displayed images. Moreover, segments of the display can be readily replaced.

Figure 2:
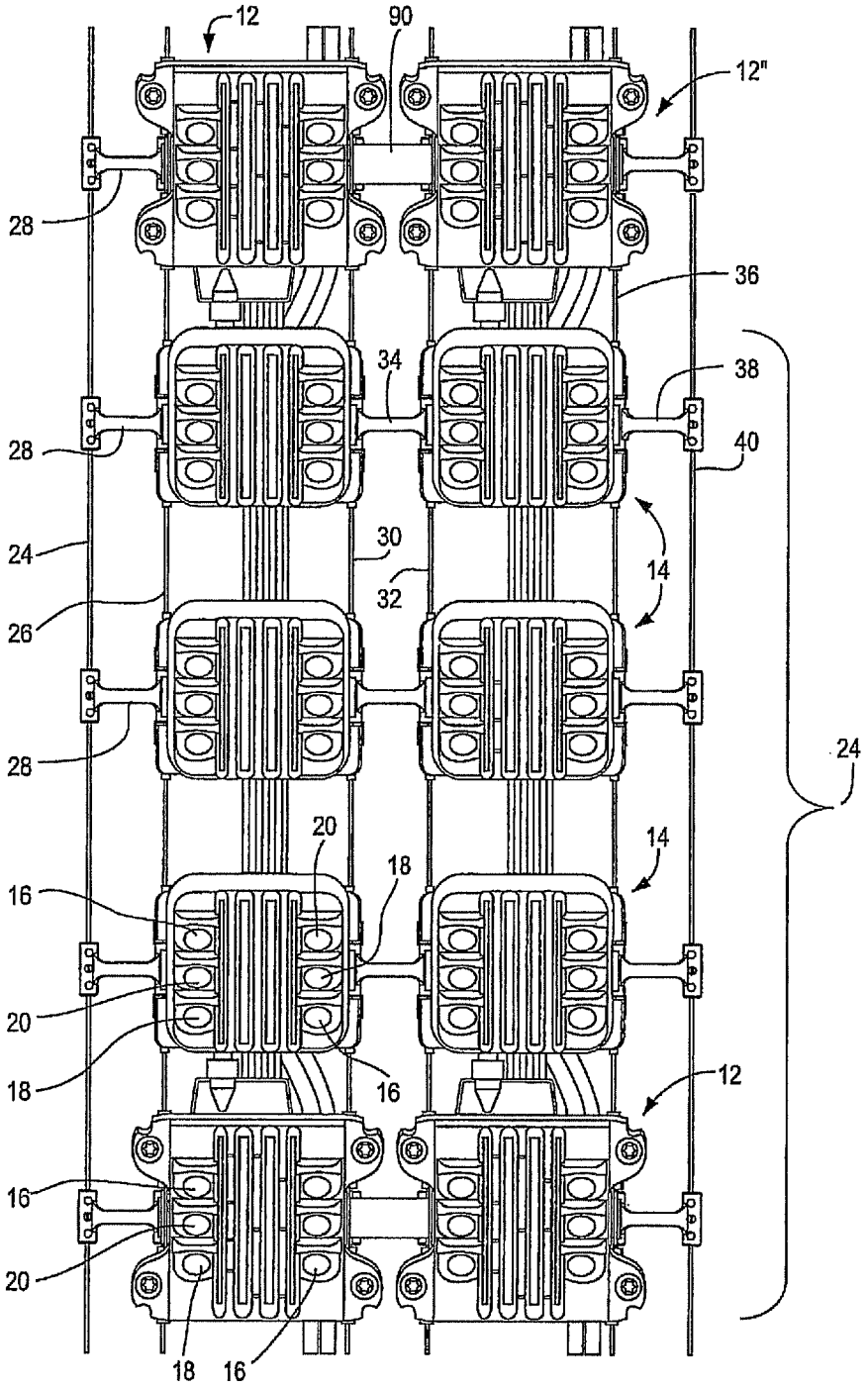
FIG. 2 is a partial front view of the display of FIG. 1, illustrating a number of LED modules mounted on the support structure for the display of the present invention.

Each pixel of the display 10 is generated by a module 12 or 14 having two red LEDs 16, two blue LEDs 18 and two green LEDs 20 mounted in a respective housing of the modules 12 or 14 as shown in FIG. 2. A circuit board contained within the housings of the modules 12 and 14 controls the intensities of the red, blue and green LEDs in order to generate pixels of a large number of different colors as is well known in the art. Although each of the modules 12 and 14 is depicted in FIG. 2 having pairs of red, green and blue LEDs, the number of red, green and blue LEDs can vary depending upon the spacing between the individual modules and the flux density of the individual LEDs. For example, where the center-to-center spacing between adjacent LED modules is 50 mm or greater, one or more red, one or more blue and one or more green LEDs can provide a light output for the display of 5,000 units or greater depending upon the flux density of the LEDs so that the display 10 is suitable for use outdoors in sunlight. For a display in which the center-to-center spacing between adjacent LED modules is 75 mm or greater, it is preferable to use a plurality of red LEDs, a plurality of green LEDs and a plurality of blue LEDs, such as three LEDs of each color, although the number of LEDs may be reduced depending upon the flux density of the individual LEDs. It should be appreciated that all of the LEDs of the modules as well as the entire display may be monochromatic as well. When monochromatic LEDs are used, changeable graphics and/or text can be displayed by turning on selected LEDs or modules. Moreover, to enhance the light output of the modules, it is preferred that the housing of each of the modules be black or a dark color as described in detail below. In accordance with another feature of the invention, however, the color of the housing is selected to match the color of the structure, such as a building, on which the display is mounted. Moreover, a single display can employ modules with different colored housings so that when the LEDs of the display are turned off, the different colored housings depict a fixed logo, graphic and/or text message.

There are two types of pixel modules employed in the display 10, master LED modules 12 and slave LED modules 14. Each master module is associated with a group of slave modules in a segment 24 of the display. Although FIG. 2 illustrates a segment as including one master LED module and three slave LED modules for simplicity, in a preferred embodiment of the present invention, each segment has one master module and fifteen slave modules to generate sixteen pixels of the display. It should be apparent, however, that the number of slave modules can vary from zero to any number depending upon the aspects of the present invention that are used. In a preferred embodiment, the segments 24 of the display 10 are linear, extending in a column of the display 10. However, segments can extend in rows of the display as well. For a 480×640 display having linear segments of sixteen pixels, there are thirty segments in each column of the display. The segments are preferably aligned so that each master module is in a row of master modules. As such, there are thirty rows of master modules with 640 master modules in each row of a 480×640 display with fifteen rows of slave modules between each of the rows of master modules.

The support structure for each of the LED modules 12 and 14 of the display 10, as shown in FIGS. 2-5, includes a first pair of parallel cables 24 and 26 and a first set of links 28 wherein each link 28 extends between the cable 24 and the cable 26. The support structure for each of the LED modules 12 and 14 also includes a second pair of parallel cables 30 and 32 and a second set of links 34 wherein each link 34 extends between the cable 30 and the cable 32. Each of the LED modules in one column of the display 10 is mounted on one cable 26 of the first cable pair and on one cable 30 of the second cable pair adjacent at least one link 28 from the first set and adjacent at least one link 34 from the second set. Each of the LED modules in an adjacent column of the display 10 is mounted on the second cable 32 of the second cable pair and a cable 36 adjacent at least one link 34 of the second set of links and adjacent at least one link 38 in a third set of links that extends between cables 36 and 40 of a third cable pair.

In a preferred embodiment, the links 28, 34, 38 on the interior of the display panel are H-shaped links that are over-molded onto the cables of each cable pair. More specifically, the two cables of a cable pair are placed in a mold into which plastic is injected around the cable to form the H-shaped links connecting the two cables of a pair. A reel to reel molding process is employed in which the over-molded links are indexed through the mold and the previously molded links are used to datum and position the subsequent links. The molding process ensures that the spacing between the links along the length of the cables is constant. The H-shaped links are used to precisely and easily locate the LED modules along the lengths of the cables so that the spacing between the LED modules in a column and the spacing between the LED modules in a row of the display 10 remains constant. Moreover, the H-shaped links provide structural integrity to the cable support structure of the display 10 to prevent sagging and misalignment of the LED modules when the display is in use. It is noted that the cables are preferably steel cables that are of a gauge sufficient to bear the load of all of the LED modules in a column of the display 10.

Figure 3:
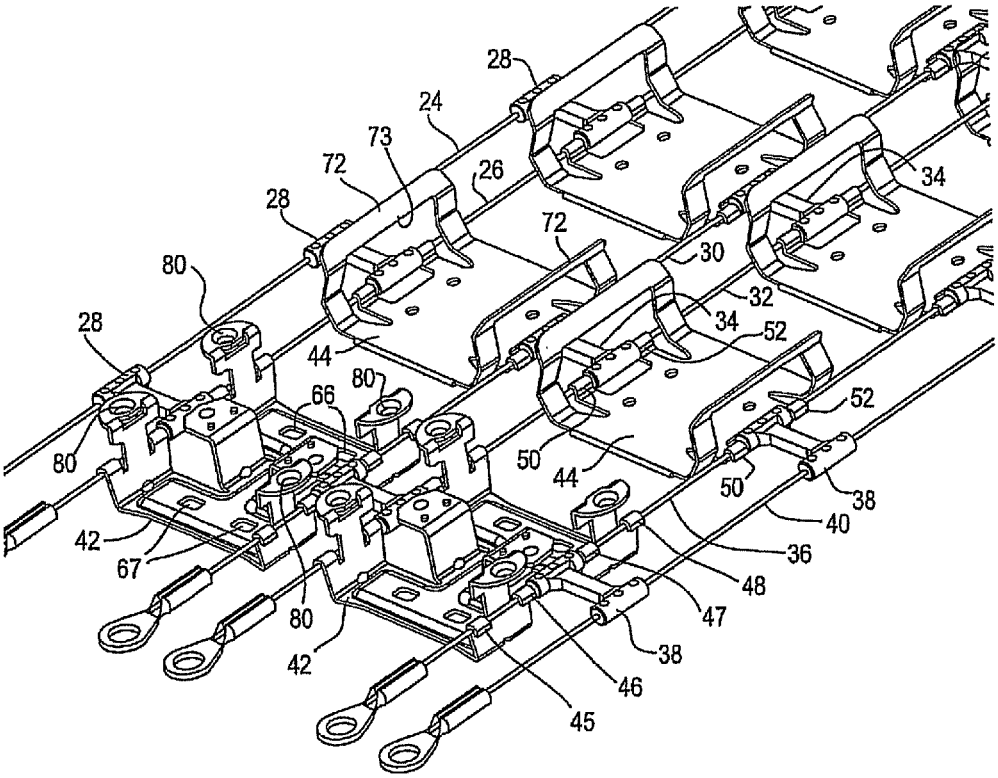
FIG. 3 is a partial perspective view of the support structure for the display of FIGS. 1 and 2.
Figure 4:
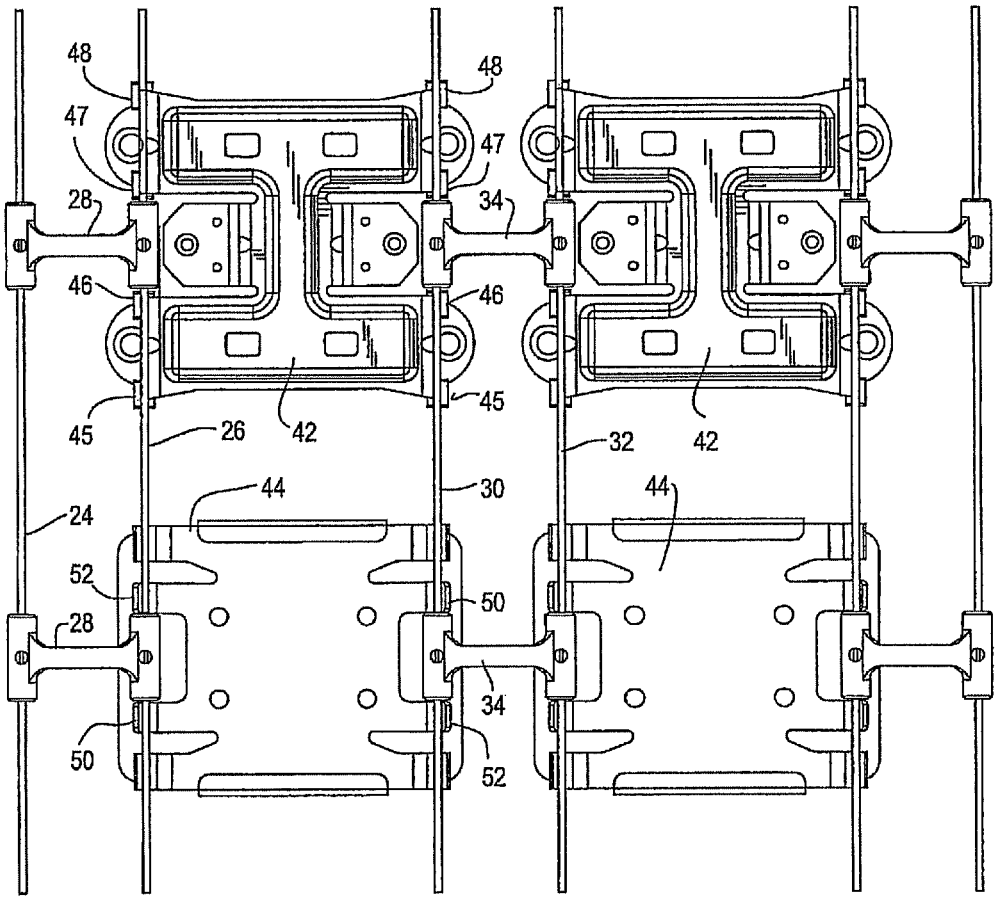
FIG. 4 is a back view of the support structure depicted in FIG. 3.
Figure 5:
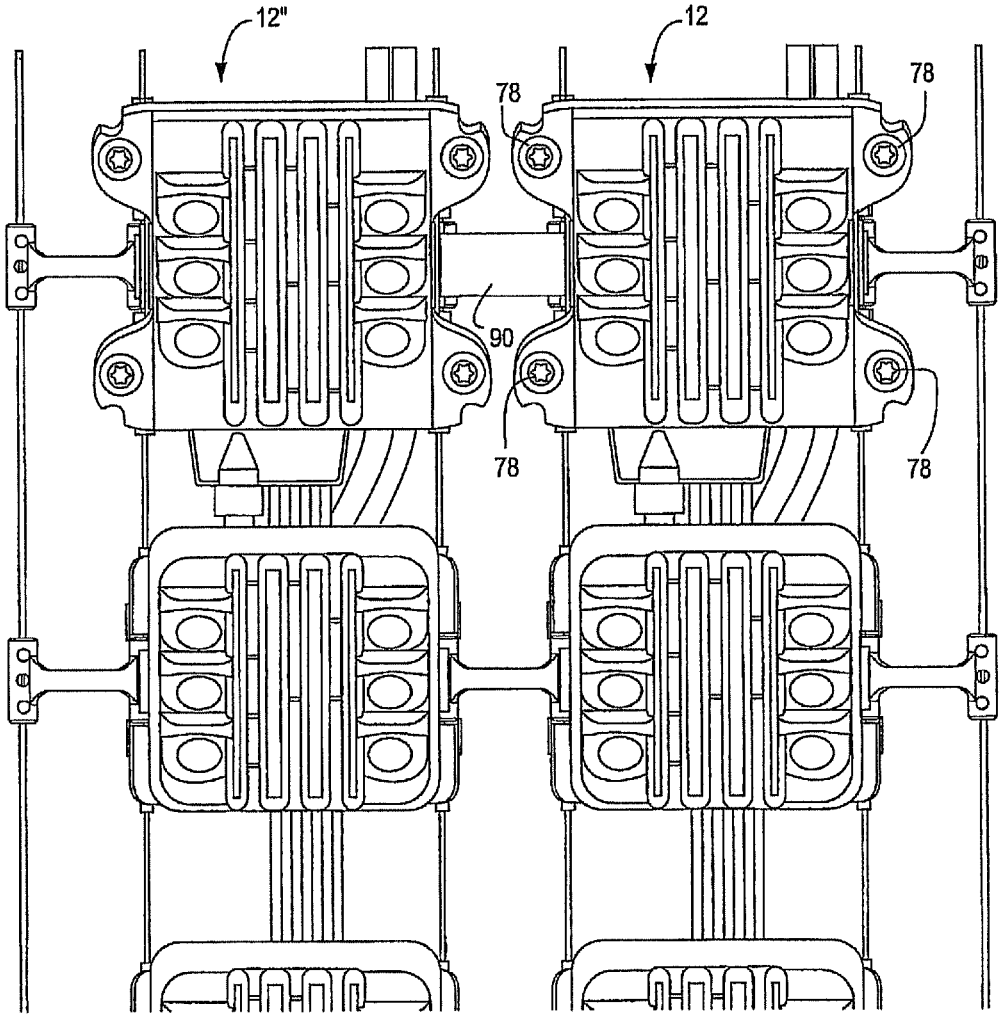
FIG. 5 is a partial front view of a pair of master LED modules and a pair of slave LED modules mounted on the support structure depicted in FIGS. 2-4.

More particularly, as depicted in FIGS. 3 and 4, the H-shaped links serve to locate steel back plates 42 of the master LED modules 12 and steel back plates 44 of the slave LED modules 14. The back plate 42 of each of the master LED modules has four arms 45-48 on each side of the plate 42 wherein the arms 45-48 are crimped onto the cables of the support structure. The two inner arms 46 and 47 of the back plate 42 are crimped onto a respective cable on either side of a leg of the H-link 38 such that the arms 46 and 47 abut the H-link with some tolerance therebetween. Similarly, the back plate 44 of the slave LED modules has two arms 50 and 52 on each side of the plate 44 wherein the arms 50 and 52 are crimped onto the cables of the support structure on either side of the H-link such that the arms 50 and 52 abut the H-link with some tolerance therebetween. Because the arms of the back plates 42 and 44 of the LED modules are crimped onto the support cables of the display 10, the arms and thus the back plates can rotate somewhat about the cables to provide enough flexibility for the display 10 so that the display 10 can conform to curved surfaces even though the H-links cannot rotate about the cables. The H-links and LED module back plates provide structural integrity for the support structure and prevent twisting, sagging and misalignment of the LED modules of the display 10. Moreover, the location of the links along the horizontal centerline of the back plates provides a structure that can be tensioned. This allows side tensioning of the mesh structure to cause the mesh to conform to a curved surface or to remove by tension any incidental wrinkles for a flat configuration. Further, the H-links form spacers between adjacent LED modules and between adjacent cables.

Figure 13:
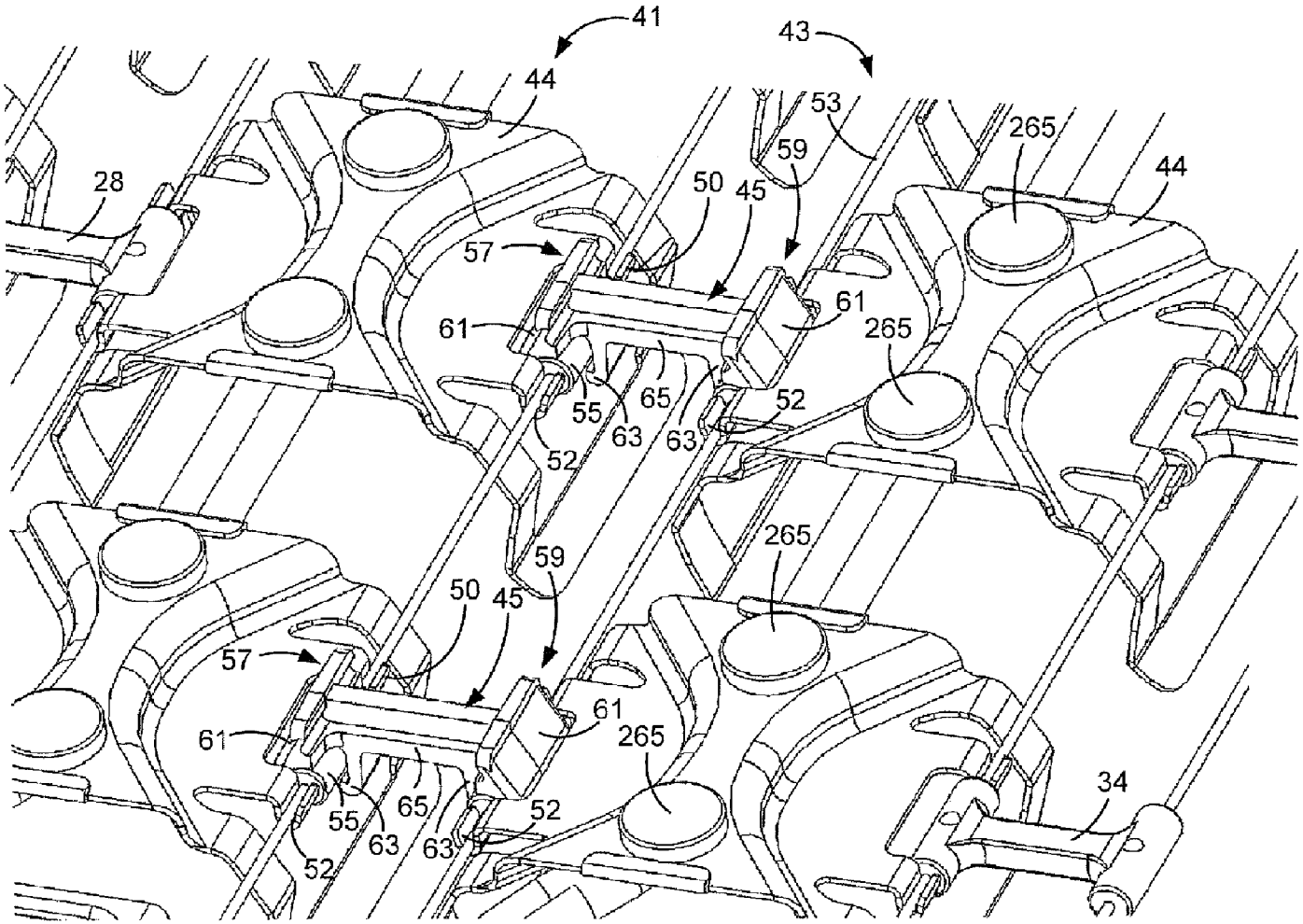
FIG. 13 is a perspective partial view of the back of a pair of display panels joined together by seam links.
Figure 14:
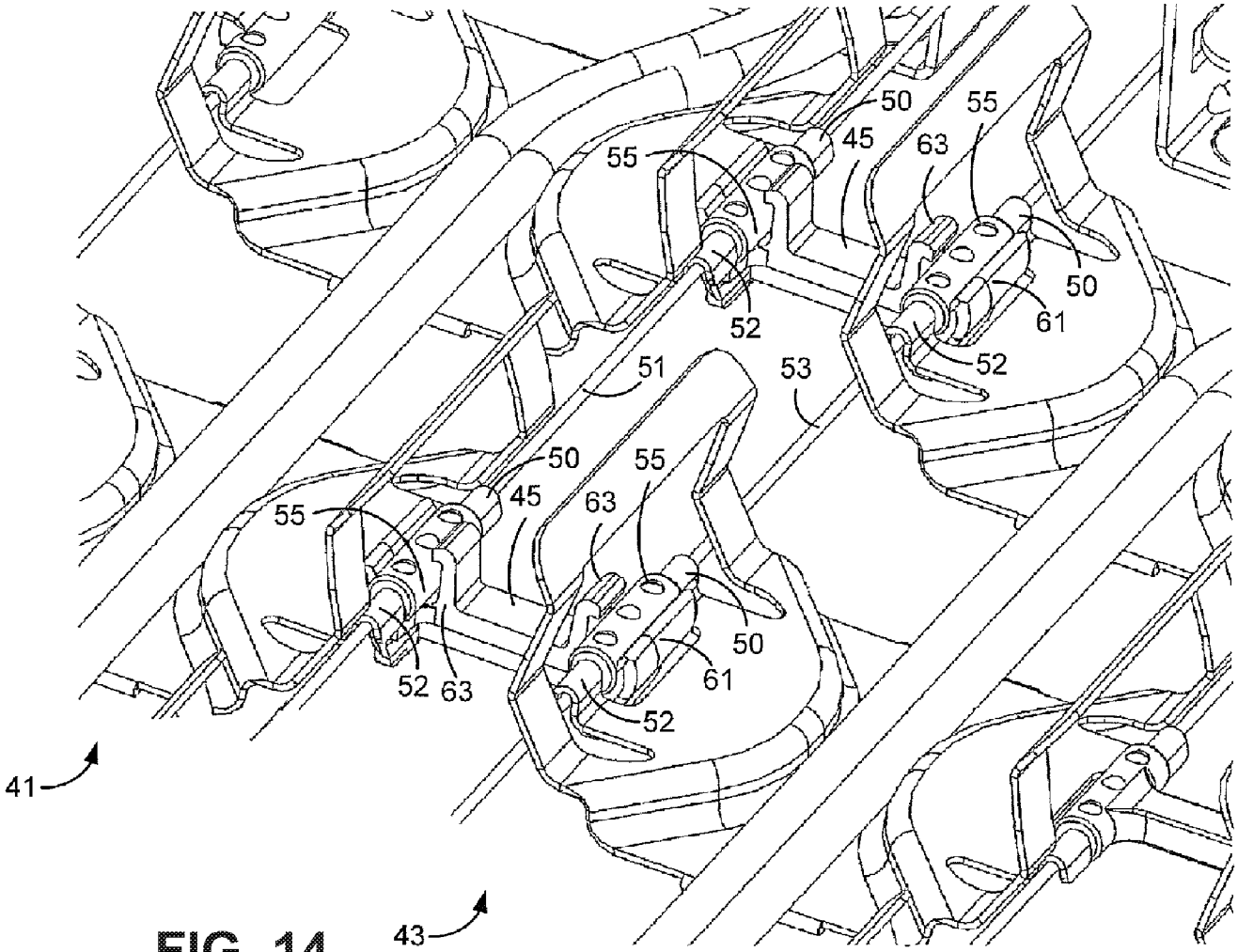
FIG. 14 is a partial perspective view of the seam links depicted in FIG. 13 as shown from the front.
Figures 15, 16:
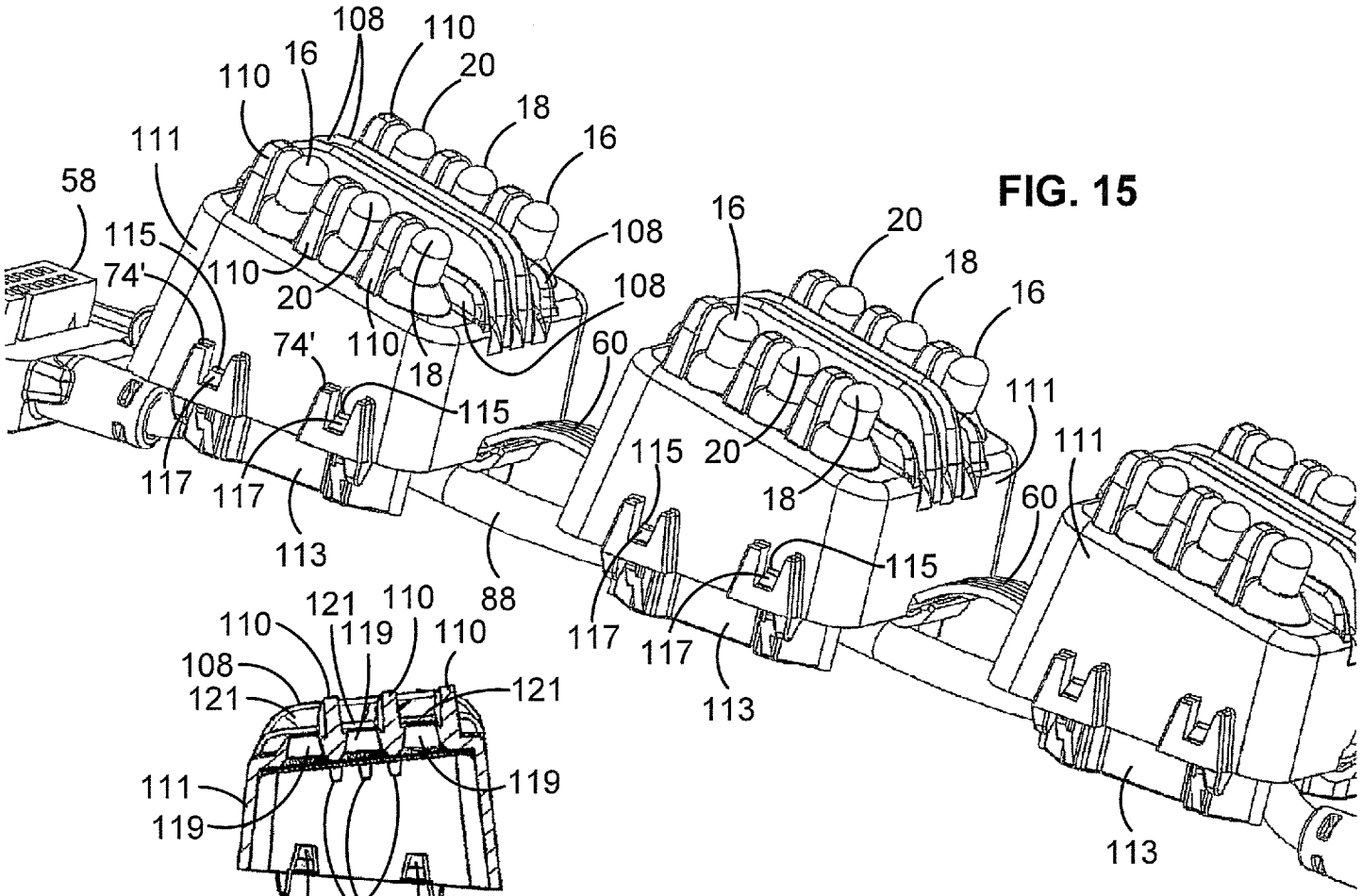
FIG. 15 is a side perspective view of an alternative embodiment of a segment of slave LED modules.
FIG. 16 is a cross sectional view of the top housing section of an LED module shown in FIG. 15.

In accordance with a preferred embodiment of the present invention, the display 10 is formed of a number of display panels for easy deployment. A display panel may have, for example, a height equal to the height of the display 10, but have a smaller number of columns than the display 10, such as sixteen columns per display panel. As shown in FIGS. 13 and 14, adjacent display panels 41 and 43 are connected together by a number of seam links 45 that snap onto a cable 51 on the edge of one display panel 41 and onto a cable 53 on the edge of an adjacent display panel 43. In a preferred embodiment, the edge cables 51, 53 of each display panel 41, 43 have seam link engagement members 55 over-molded onto the edge cables wherein the spacing between the seam link engagement members 55 along the length of the edge cables 51, 53 is constant and preferably equal to the spacing between the H-shaped links along the length of the interior cables of the display panel. The same type of reel to reel molding process is used to over-mold the seam link engagement members 55 as is used to over-mold the H-links 28, 34, 38. The seam link engagement members 55 have a generally I-shape or cylindrical shape and preferably have the same length as the legs of the H-links. Moreover, the seam link engagement members 55 are preferably aligned in a row of LED modules with the H-links in that row. Like the legs of the H-links, the seam link engagement members 50 serve to locate the steel back plates 44 of the LED modules in the first or last column of a display panel 41, 43. Specifically, the arms 50 and 52 on one side of the back plate 44 are crimped onto an edge cable 51 or 53 on either side of a seam link engagement member 55 such that the arms 50 and 52 abut the seam link engagement member 55 with some tolerance therebetween. The seam links 45 have a first end 57 and a second end 59 each having a pair of arms 61 and 63 that snap about a seam link engagement member 55. The width of the outer arms 61 of the ends 57 and 59 of the seam links 45 is greater than the width of the cross bar section 65 extending between the ends 57 and 59 for structural integrity. The length of the cross bar section 65 of the seam links 45 is preferably the same as the length of the cross bar extending between the legs of the H-links 28, 34, 38 so that the spacing between display panels is the same as the spacing between columns of LED modules of a panel. Like the H-links, the seam links form spacers between adjacent LED modules and cables.

It is noted that when a seam link 45 snaps onto a pair of seam link engagement members 55, the link 45 and members 55 form a multi-piece H-link. As such, the one-piece H-links connecting adjacent interior cables of a display panel can be replaced with the multi-piece H-links formed of a seam link 45 and a seam link engagement member 55 such that any or all of the columns of the display 10 are connected by seam links 45. It is also noted that the seam link engagement members can be eliminated so that the seam links snap directly onto a cable. It should be appreciated that to join two display panels together, a seam link 45 need not be used in every row of LED modules. For example, if the display 10 is mounted such that its back is against a wall of a building or the like, a seam link may be needed in only every third slave LED module row. If, however, the display is a free standing, outdoor display so that wind passes through the display, a seam link may be used on every slave LED module row to join the display panels.

It is further noted that the H-links and seam links, for cable spacings of approximately 12.7 mm and a center to center spacing between adjacent LED modules of 50 mm, are substantially rigid. However, as the center to center spacing between adjacent LED modules increases to 75 mm, 100 mm or greater, the length of the H-links, the seam links and the spacing between cables may also increase. For such displays, the H-links and seam links may be formed so that they are somewhat flexible and capable of bending to conform to a curve. It is also noted that nonplanar light displays can be formed in accordance with the present invention by using different size H-links and/or seam links to provide different size spacings between LED modules. For example, using different size spacers, i.e. H-links or seam links, light displays of different geometries such as a sphere or a portion thereof can be formed. Moreover, a display having an approximately 75 mm center to center spacing between adjacent LED modules can easily be formed from a display having a smaller center to center LED module spacing, such as 50 mm, by eliminating every other slave LED module in the display having the smaller center to center module spacing. Similarly, for a display having an approximately 100 mm center to center spacing between adjacent LED modules, one need only eliminate every other slave LED module and every other column of master LED modules and associated slave LED modules in a display having the 50 mm center to center LED module spacing. When an LED module is eliminated, the back plate for the LED module is preferably replaced with a simple flat metal clip that may have a dog-bone shape. Like the back plates, the metal clip is crimped onto the cables such that the arms of the metal clip abut an H-link or seam link engagement member with some tolerance therebetween as discussed above.

Figure 6:
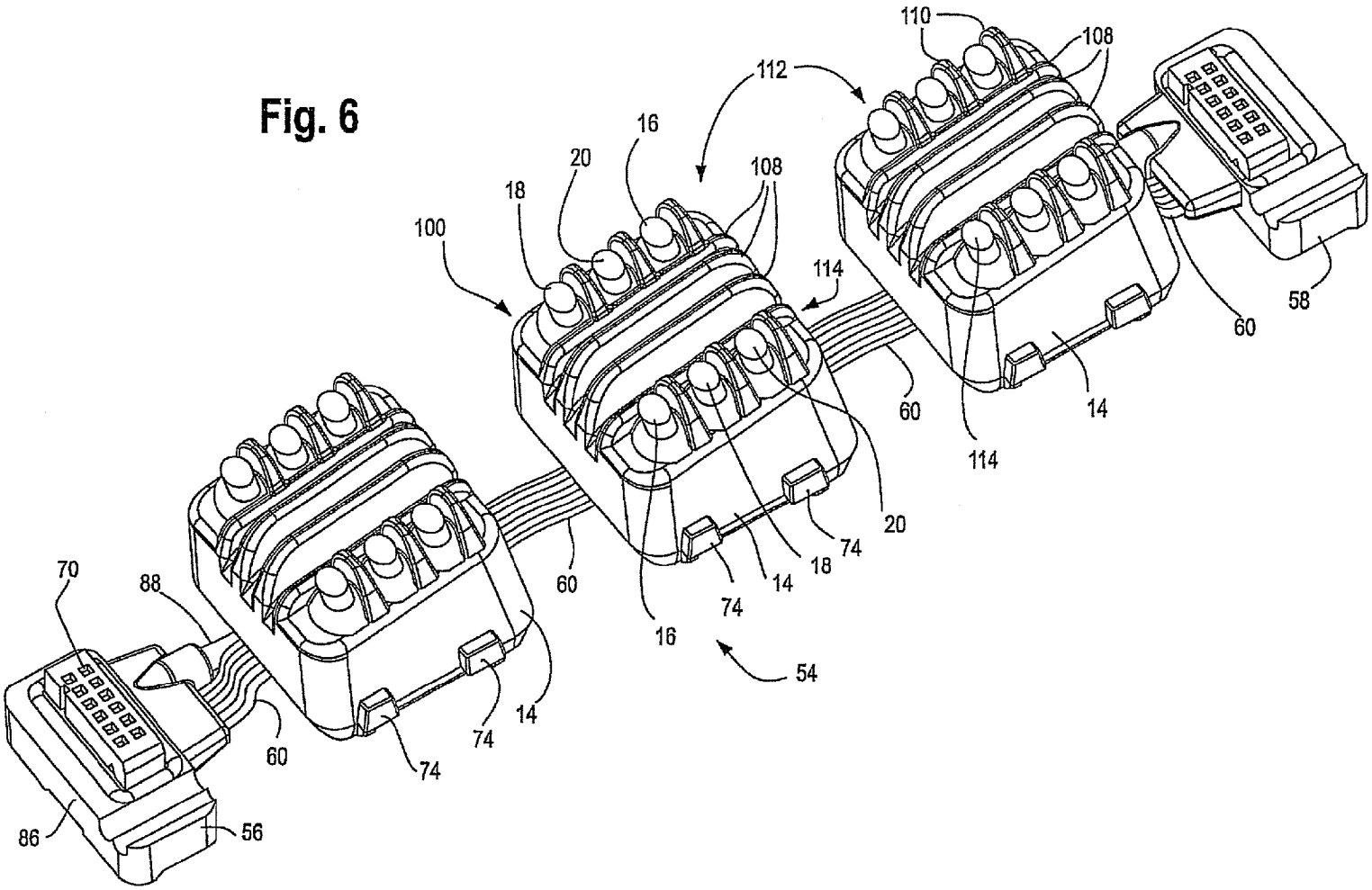
FIG. 6 is a perspective view of a segment of slave LED modules in accordance with one embodiment of the present invention.
Figure 7:
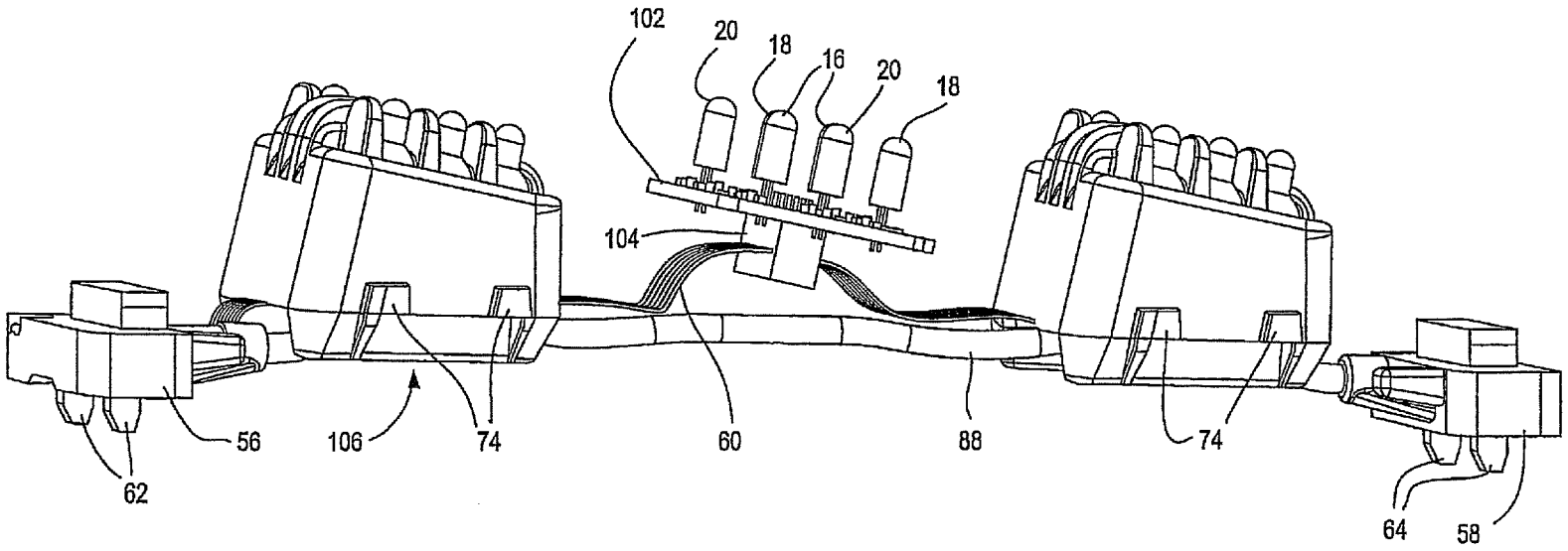
FIG. 7 is a side perspective view of the segment of slave LED modules depicted in FIG. 6 with the housing of one of the modules removed.
Figure 8:
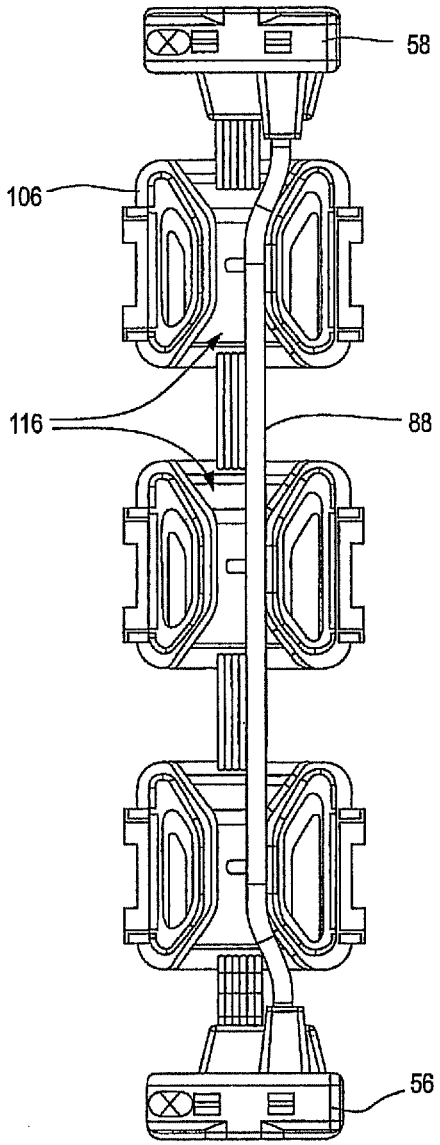
FIG. 8 is a back view of a segment of slave LED modules as depicted in FIG. 6.
Figure 9:
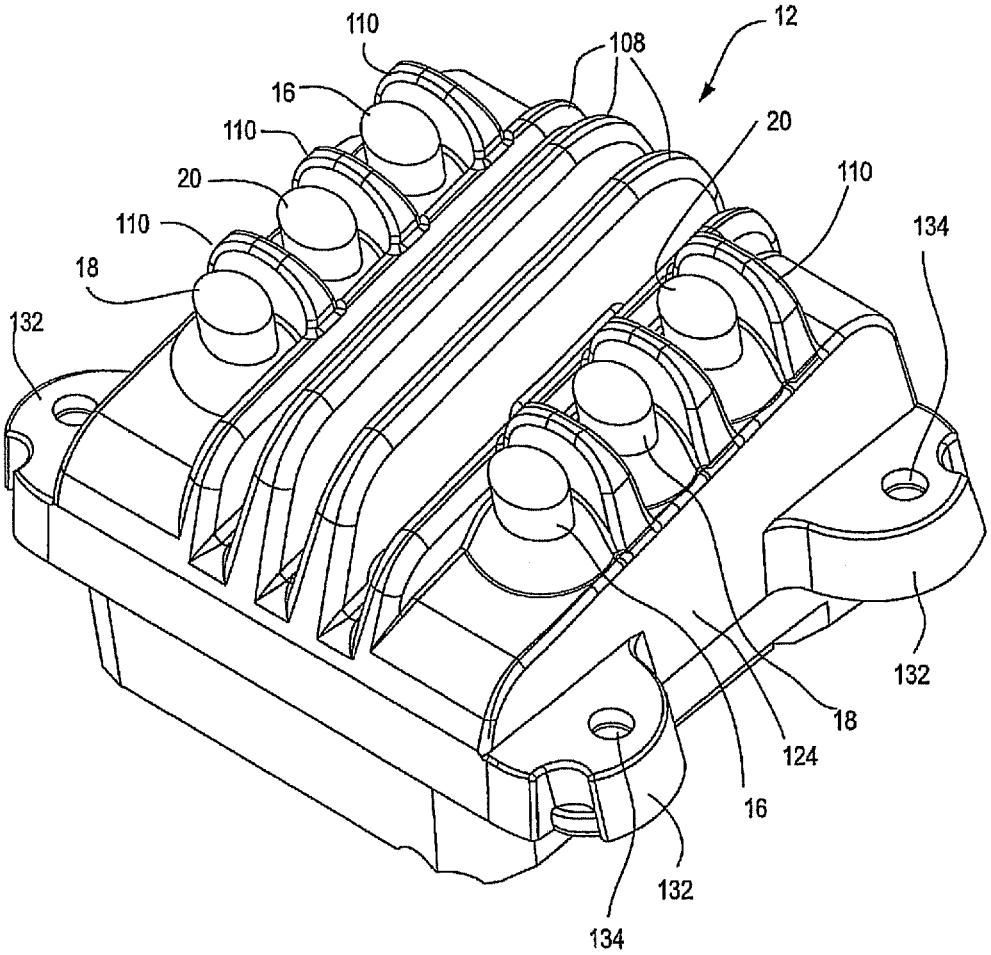
FIG. 9 is a front perspective view of a master LED module in accordance with one embodiment of the present invention.
Figure 10:
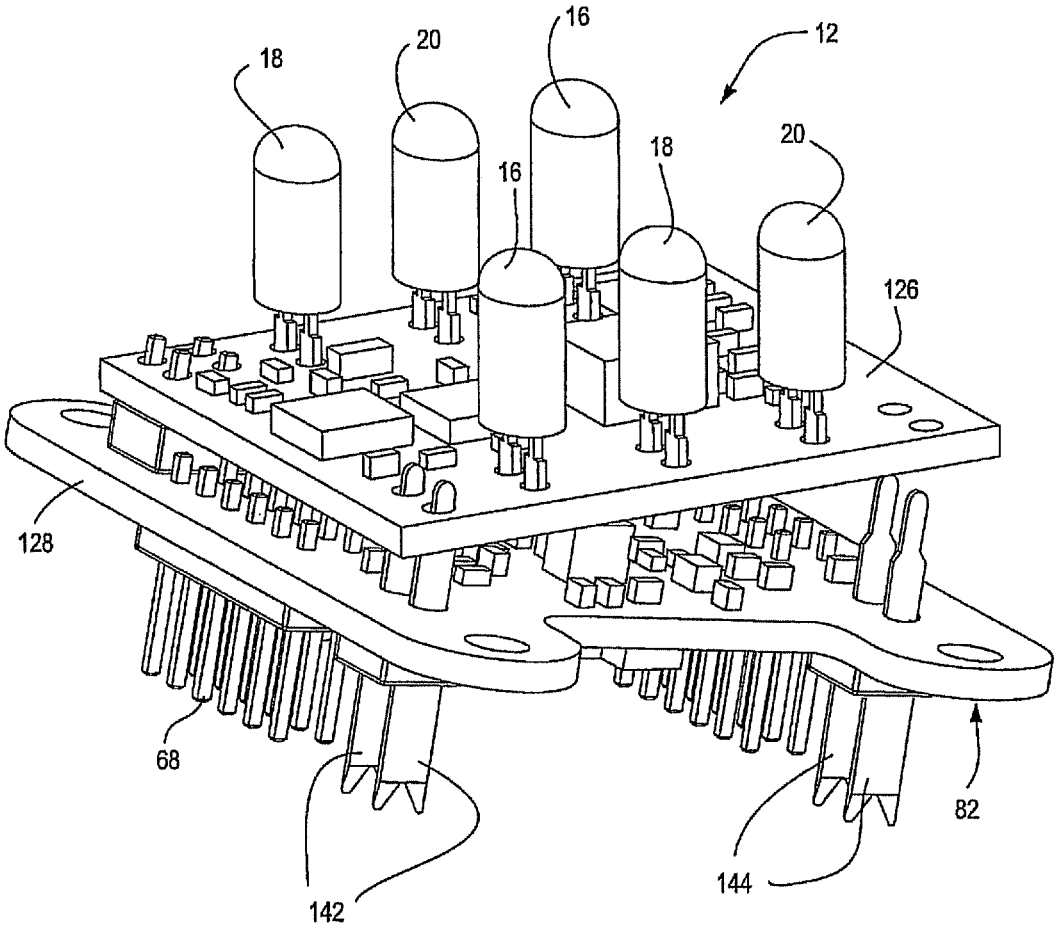
FIG. 10 is an illustration of the circuit boards and connectors for the master LED module depicted in FIG. 9.
Figure 11:
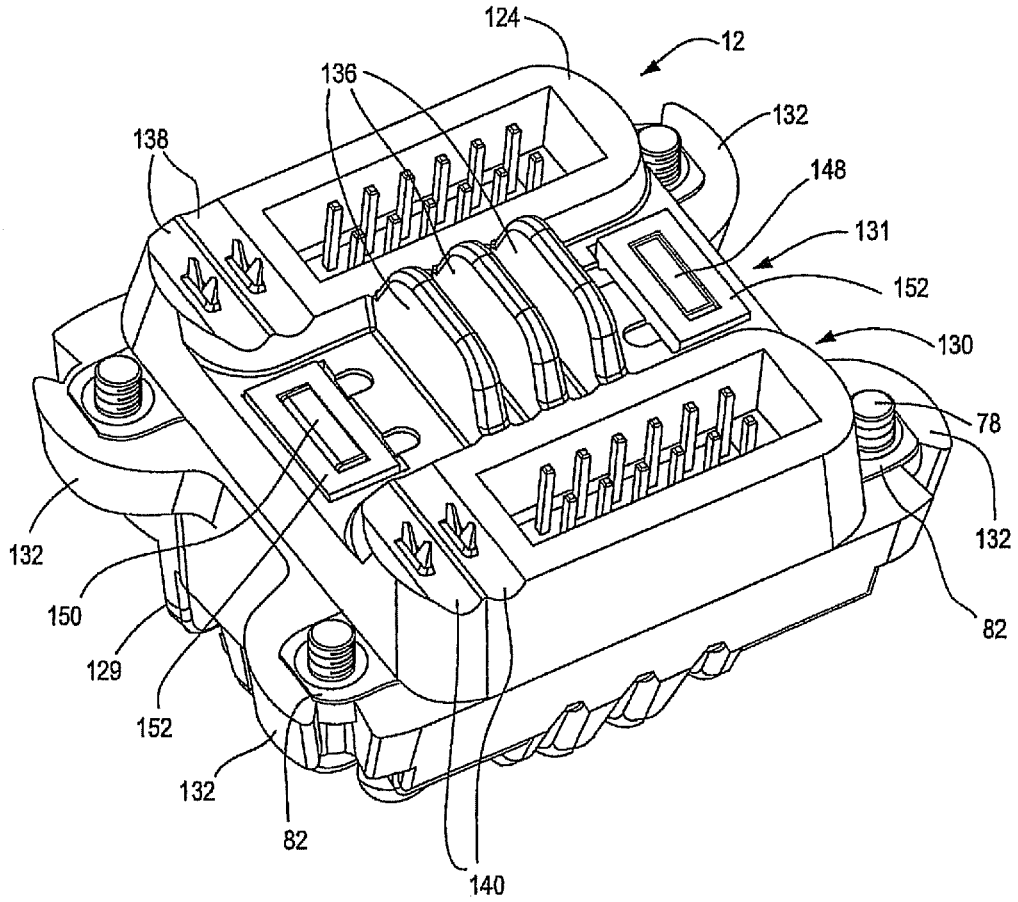
FIG. 11 is a back perspective view of the master LED module of FIG. 9.
Figure 12:
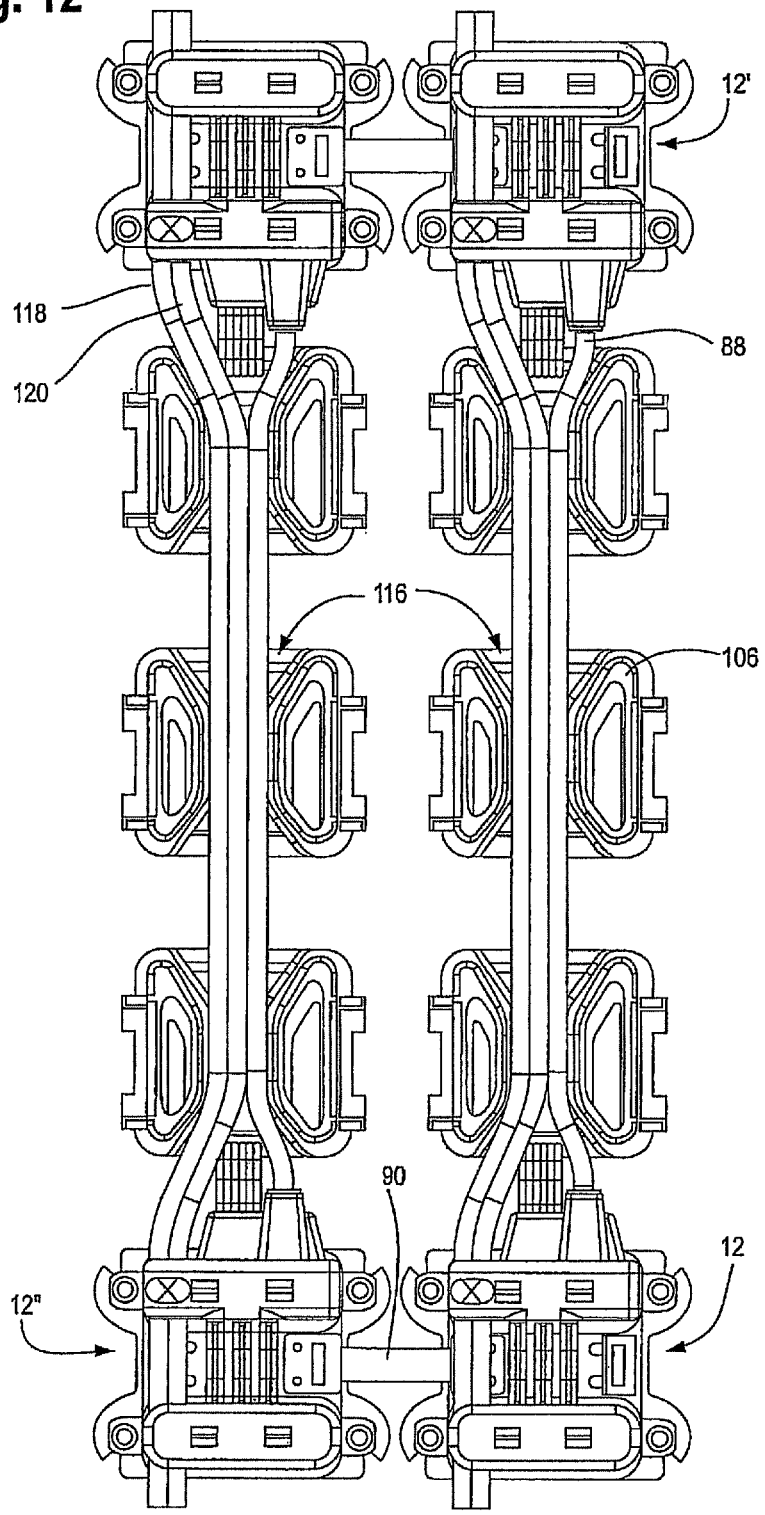
FIG. 12 is a back view of a pair of slave LED module segments connected between respective master LED modules.

Both the master LED modules 12 and the slave LED modules 14 are removably mounted on the respective back plates 42 and 44 so that the individual master LED modules 12 and/or a slave module segment 54 can be removed and replaced after the display 10 is installed. As seen in FIGS. 6-8, a slave module segment 54 includes a first electrical connector 56 that is fixedly attached to one end of the segment 54 and a second electrical connector 58 that is connected to a second end of the segment 54. A number of spaced slave LED modules 14 are connected between the first and second electrical connectors 56 and 58 via ribbon cables 60. The ribbon cables 60 carry power and data to each of the slave LED modules 14 of the segment 54 from a master module 12 that is connected to one of the electrical connectors 56.

As seen in FIGS. 7 and 8, each of the electrical connectors 56 and 58 of a slave module segment 54 includes a pair of downwardly extending rubber or elastomeric prongs 62 and 64. The prongs 62 of the electrical connector 56 snap through apertures 66 formed in the master LED module back plate 42. After the electrical connector 56 of the slave module segment 54 is snapped into the apertures 66 of a master module back plate 42, each of the slave modules of the segment 54 are snapped on to a respective back plate 44. As a slave LED module 14 is snapped on to its back plate 44, a pair of module retaining members 72 are forced apart When the slave module 14 is snapped into its back plate, the lower edge 73 of the retaining members 72 abuts the tops of a pair of protrusions 74 formed on the side walls of the slave LED module housing 100 to retain the slave module 14 securely on the back plate 44. The electrical connector 58 on the second end of the slave module segment 54 is inserted in apertures 67 of a master LED module back plate 42 in the next row of master modules. After the slave module segment 54 is mounted on the back plates of the cable support structure, a master LED module 12 is mounted on the back plate 42. Specifically, a master LED module 12 is mounted on the back plate 42 on top of the connector 56 with mating connector pins 68 of the module 12 extending into the apertures 70 of the electrical connector 56. Each of the master LED modules 12 is secured to a back plate 42 by four screws 78 that extend through apertures 80 of the back plate 42. In a preferred embodiment, the back plate 42 of the master LED modules is formed of steel or the like so that the back plate forms a heat sink that is in contact with the ground plane 82 of the printed circuit board 128 contained in the master LED module housing 124 as discussed in detail below. The back plate 42, as well as the back plate 44, also preferably includes one or more bumpers 265 as shown in FIG. 13 for back plate 44. The bumpers 265 are made of an electronic material and provide a cushion between the back of the display 10 and a surface of a building or the like on which the display is mounted. It is noted, that when the master LED module 12 is bolted onto the back plate 42, the over-molded elastomeric pads 86 of the electrical connector 56 are compressed so as to provide a water tight seal between the master LED module 12 and the electrical connector 56 of the slave module segment 54 to protect the connector from environmental effects.

The master LED module connected to the slave LED module segment 54 via the connector 56 provides data and power to the slave LED modules 14 of the segment 54 via the ribbon connector 60. A LVDS cable 88 that extends from the first electrical connector 56 and the second electrical connector 58 provides a direct electrical connection between a pair of master LED modules 12 and 12' of adjacent segments 24 in a column of the display 10 to allow the master LED modules of adjacent segments in a column to communicate directly as discussed in detail in the co-pending patent application Ser. No. 12/001,277 entitled "Data And Power Distribution System And Method For A Large Scale Display," filed concurrently herewith and incorporated herein by reference. Adjacent master LED modules 12 and 12" in a row of the display 10 communicate directly via a flex cable 90. In a preferred embodiment, the flex cable 90 overlies a H-link 34 connecting the support cables 32 and 30 as depicted in FIG. 2.

Each of the slave LED modules 14 includes a housing 100 that is over-molded about the slave module printed circuit board 102 on which the LEDs of the module are mounted and about a portion of the ribbon cables 60 connected to the printed circuit board 102 by a IDC connector 104. Each slave LED module is connected to the ribbon cable in a common-bus manner so that a failure of any connection does not affect the other slave modules. In order to over-mold the housings of the slave LED modules 14, a string of, for example, fifteen printed circuit boards 102 supporting the LEDs for respective slave modules are placed in a mold wherein the fifteen printed circuit boards are connected by respective ribbon connectors 60 in a string. Thereafter, a thermoset or thermoplastic resin is injected into the mold to form a casing or housing 100 about the printed circuit boards 102 and ribbon connectors 104. The over-molded housing of the LED modules provides extremely robust modules that can withstand harsh outdoor weather. Prior to injecting the resin to form the housing 100 of the slave LED modules 14, a flash memory contained on the circuit board 102 is programmed with the address of the slave LED module. For a slave module segment 54 having fifteen slave LED modules, the slave modules will have an address of 1 to 15 starting in sequence with the slave LED module that is closest to the electrical connector 56 to be attached to the master LED module that will control the slave modules in a segment 24 of the display. It is noted that, while the printed circuit boards are in the molding fixture, the electronics on the boards 102 can be tested prior to over-molding. It is noted, that the mold for the slave LED module housings supports the printed circuit board 102 for the LEDs at a 10° angle from the back surface 106 of the housing. As such, when the slave LED module segment 54 is mounted vertically, the LEDs are angled downward by 10° for better viewing of the pixels generated by the slave modules when the display is in use. It should be appreciated, however, that the angle of the LEDs can be 0° to 20° where the LEDs are angled up, down or to the side depending upon the use of the display.

Each of the housings 100 for the slave LED modules 14 has integrally formed fins 108 on a front surface of the housing between a first column 112 of red, green and blue LEDs and a second column 114 of red, green and blue LEDs. The fins 108 can function as heat sinks and/or light traps to enhance contrast. Placing the fins 108 between the LEDs of the module, which are actuated to form a single pixel, does not interfere with the light generated by the LEDs to form the pixel, but instead enhances contrast. It is noted, in a preferred embodiment, the LEDs in the first column have an order of red, green and blue; whereas the LEDs in the second column have an order of green, blue and red so as to provide better color mixing to generate the various colors of a pixel.

Each of the housings 100 for the slave LED modules 14 also has integrally formed sunshades 110 that project outwardly above each of the LEDs 16, 18 and 20. It is noted, that in an alternate embodiment that does not have the fins 108 on the front surface of the housing 100, one sunshade 110 may be positioned above each row of LEDs. The fins 108 and sunshades 110, as well as the black or dark resin used to form the housing 100 of the LEDs, enhance the contrast or conspicuity of the pixels generated by the modules 14 when the display 10 is used outdoors.

As shown in FIG. 8, the housing 100 of each of the slave LED modules 14 is molded so as to form a channel 116 in the back surface 106 of the housing 100. The channel 116 is sufficiently wide so as to be able to accommodate the cable 88 therein as well as a pair of power cables 118 and 120. The channels 116 of the housings 100 are aligned with the ribbon cables 60 so that the LVDS cable 88 and the power cables 118 and 120 are aligned in back of the ribbon cables 60. Thus, when viewed from the front of the display 10, the cables 88, 118 and 120 are not readily visible. Further, because the cables 88, 118 and 120 are aligned behind the ribbon cables 60, the display still has open areas between the modules so that if the display 10 is hung in an open area outdoors, there is relief for wind. Moreover, the open areas permit viewing through the display. Such a semi-transparent display will not block the view out of windows of a building upon which the display is hung.

In an alternative embodiment, instead of having an overmolded housing, the slave LED modules of a segment as shown in FIGS. 15-19 have a housing that includes a top housing section 111 that snaps onto a retainer clip 113 forming a bottom housing section. The electrical components contained in the housing formed by the housing sections 111 and 113 are encapsulated and sealed in a potting material. The top housing section 111 is formed with fins 108 and sunshades 110 as described above for the housing 100. The pair of protrusions 74' formed on the sidewalls of the top housing section 111 to secure the slave LED module to the back plate 44 are similar to the protrusions 74 of the housing 100, except that each of the protrusions 74' has an aperture 115 therein through which an arm 117 of the retainer clip 113 extends when the top housing section 111 is snapped onto the bottom housing section 113. The top housing section 111 also includes a conically shaped seal 119 that extends about each of the apertures 121 through which the LEDs 16, 18 and 20 extend. When the top housing section 111 is mounted over the printed circuit assembly 127 on which the LEDs are mounted, the LEDs are pushed through the seals 119 without any clearance therebetween so as to prevent the potting material from leaking through the top housing section 111. The interior of the top housing section 111 includes a number of downwardly extending locating pins which abut a top surface of a board 125 of the printed circuit assembly 127 to locate the housing with respect to the assembly 127.

Figure 17:
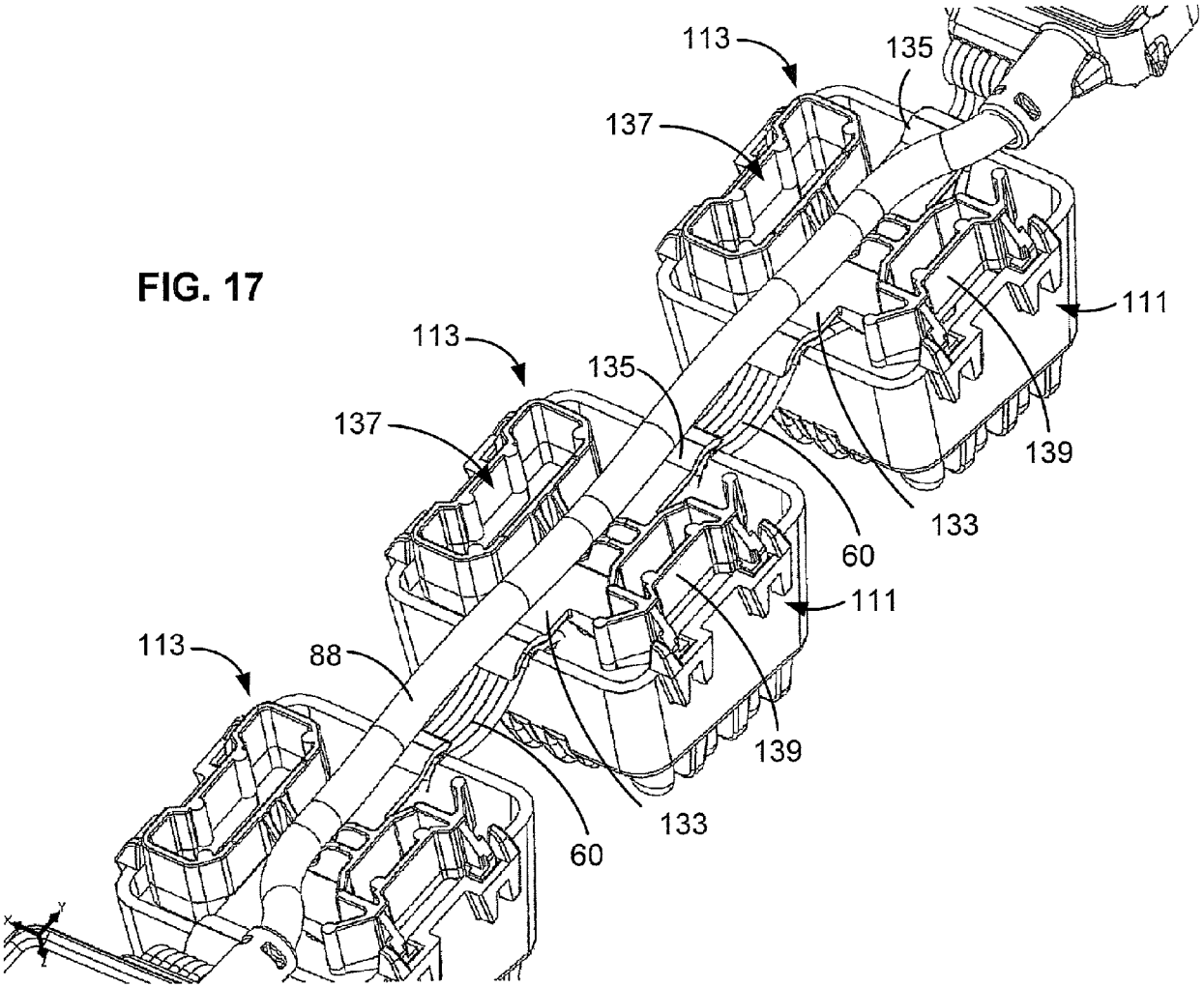
FIG. 17 is a back view of the segment of slave LED modules depicted in FIG. 15.

As shown in FIG. 17, the retainer clip 113 forming the bottom housing section of the slave LED module has a channel 131 formed on a back surface thereof to align the cable 88 in back of the ribbon cable 60, similar to the channel 116 in the back surface of the housing 100. When the cable lies in the channel 131, the cable 88 overlies a pair of arms 133 and 135 of the retainer clip 113 wherein the arms 133 and 135 provide strain relief for the ribbon cable 60. The retainer clip also includes a pair of ports and/or wells 137 and 139 on opposite sides of the retainer clip. The potting material is injected through the ports/wells 137, 139 to evenly distribute the potting material within the module housing.

Figure 18:
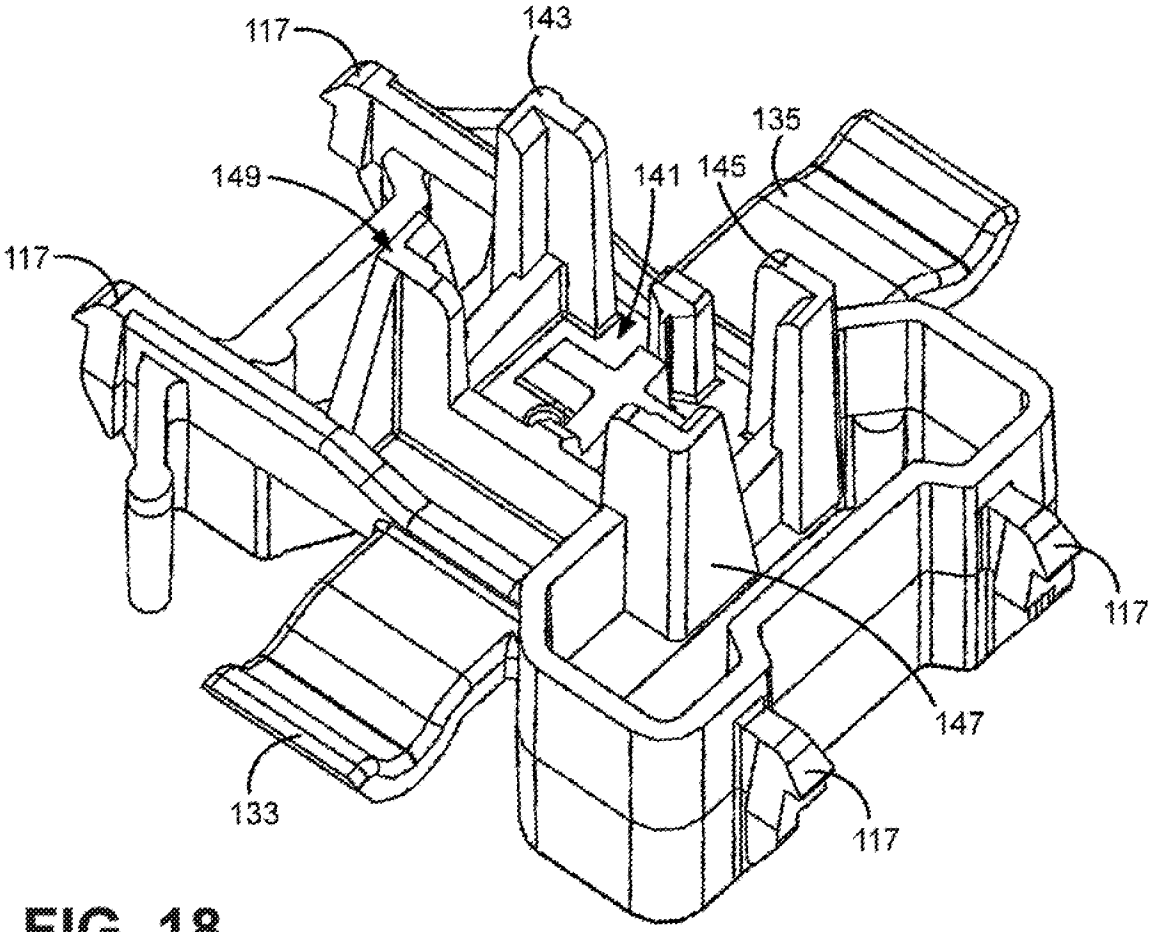
FIG. 18 is a top perspective view of a retainer clip forming the bottom housing section of a LED module depicted in FIG. 15.
Figure 19:
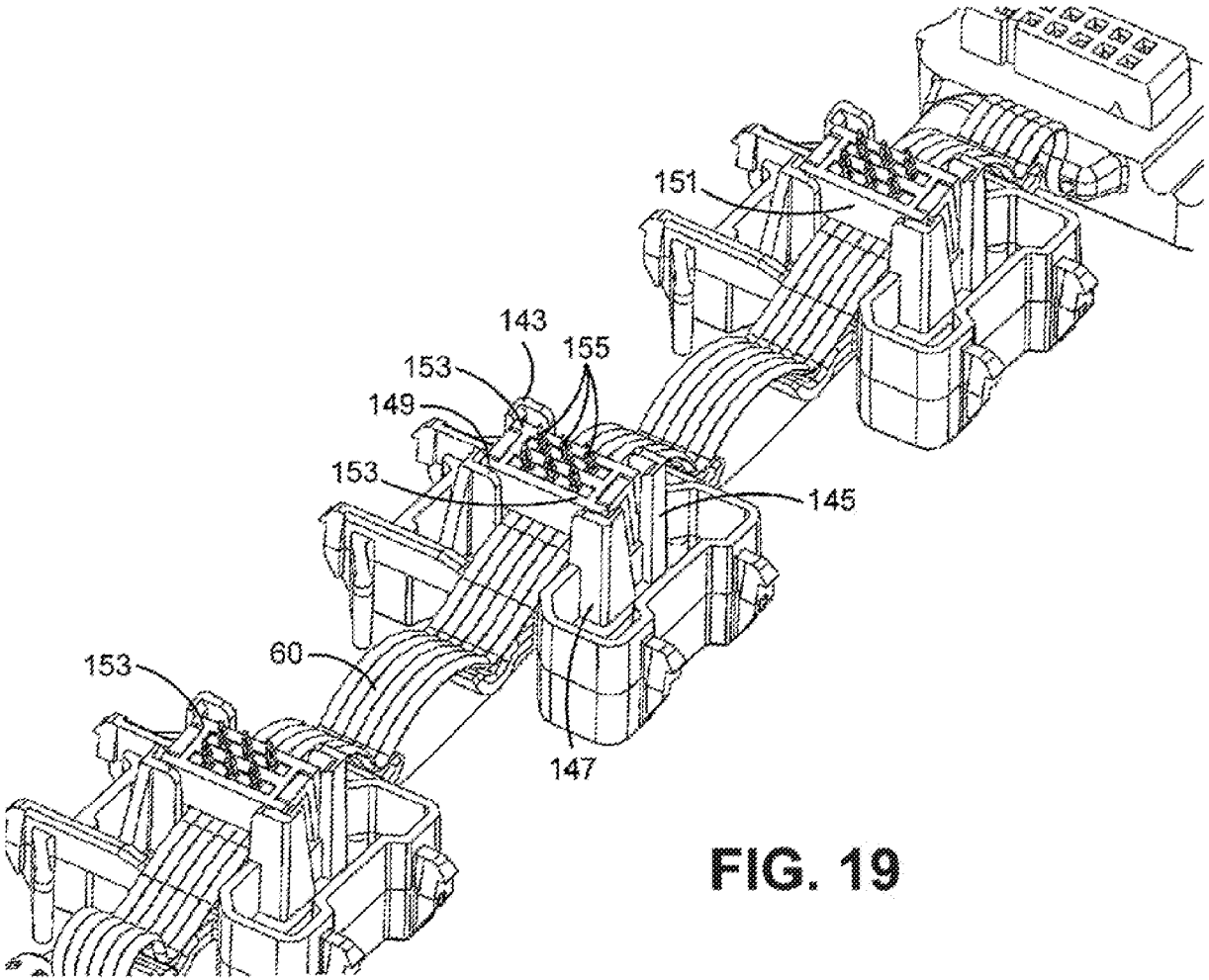
FIG. 19 is a perspective view of the electrical connectors of a ribbon cable seated in the retainer clip housing section depicted in FIG. 18.
Figure 20:
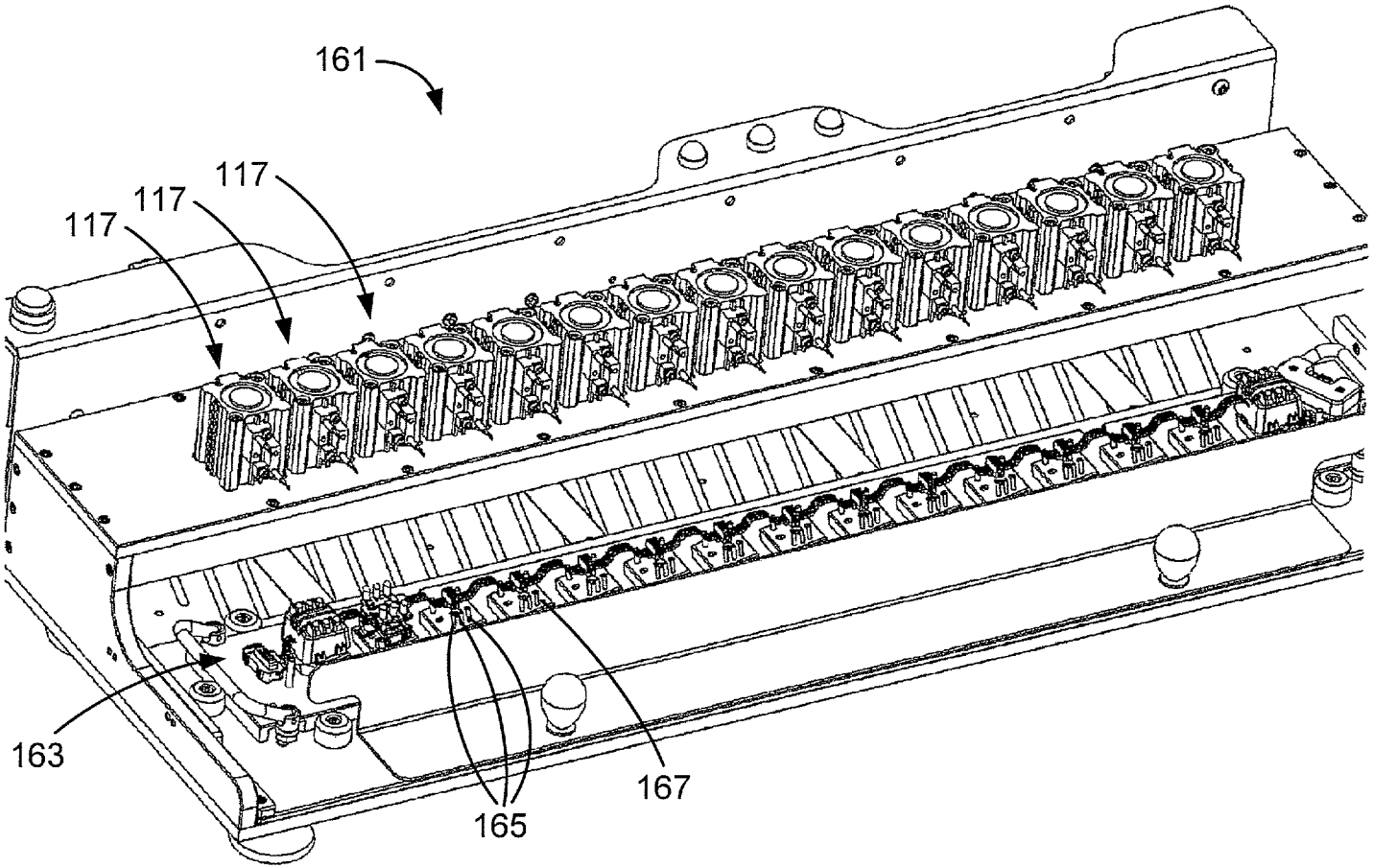
FIG. 20 is a perspective view of a press fixture for assembling a segment of slave LED modules as depicted in FIG. 15.
Figure 21:
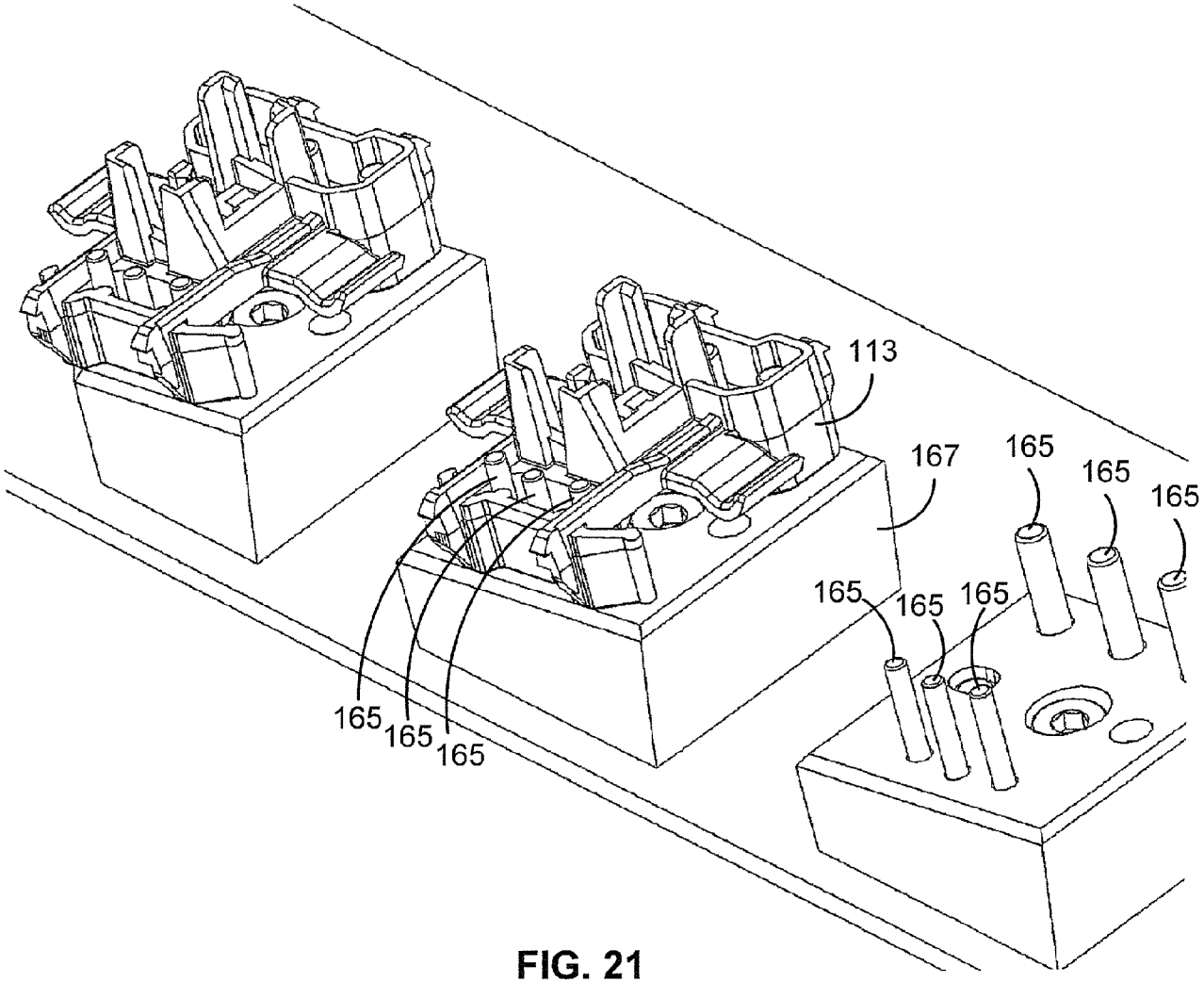
FIG. 21 is a perspective view of the retainer clip housing section mounted on a portion of the fixture of FIG. 20.

The front surface of the retainer clip 113 as shown in FIGS. 18 and 19 includes a seat 141 that locates an electrical connector 151 within the LED module housing formed by the housing sections 111 and 113. The seat 141 for the electrical connector 151 is defined by four corner walls 143, 145, 147 and 149. The walls 147 and 149 have an aperture or opening therebetween to accommodate the ribbon cable 60 one side of the connector 151. Similarly, the walls 143 and 145 have an opening or aperture therebetween to accommodate the ribbon cable on the opposite side of the connector 151. The electrical connector 151 has solderless, compliant connector pins 155 that extend through contact apertures in the board 125 of the printed circuit assembly 127 so as to electrically connect the ribbon cable carrying power and/or data to the slave LED modules to the printed circuited assembly 127. The walls 143, 145, 147 and 149 of the seat 141 extend slightly above the top surface 153 of the electrical connector 151 so that when the board 125 of the printed circuit assembly 127 is correctly mounted on the connector 151, the board 125 rests on a top surface of the walls 143, 145, 147 and 149 such that compliant connector pins 155 are compressed within the apertures of the printed circuit assembly board so as to provide good electrical contact between the pins 155 and the board 125. As such, the walls of the seat 141 serve to properly locate the printed circuit assembly board on the connector 151 within the LED module.

Figure 22:
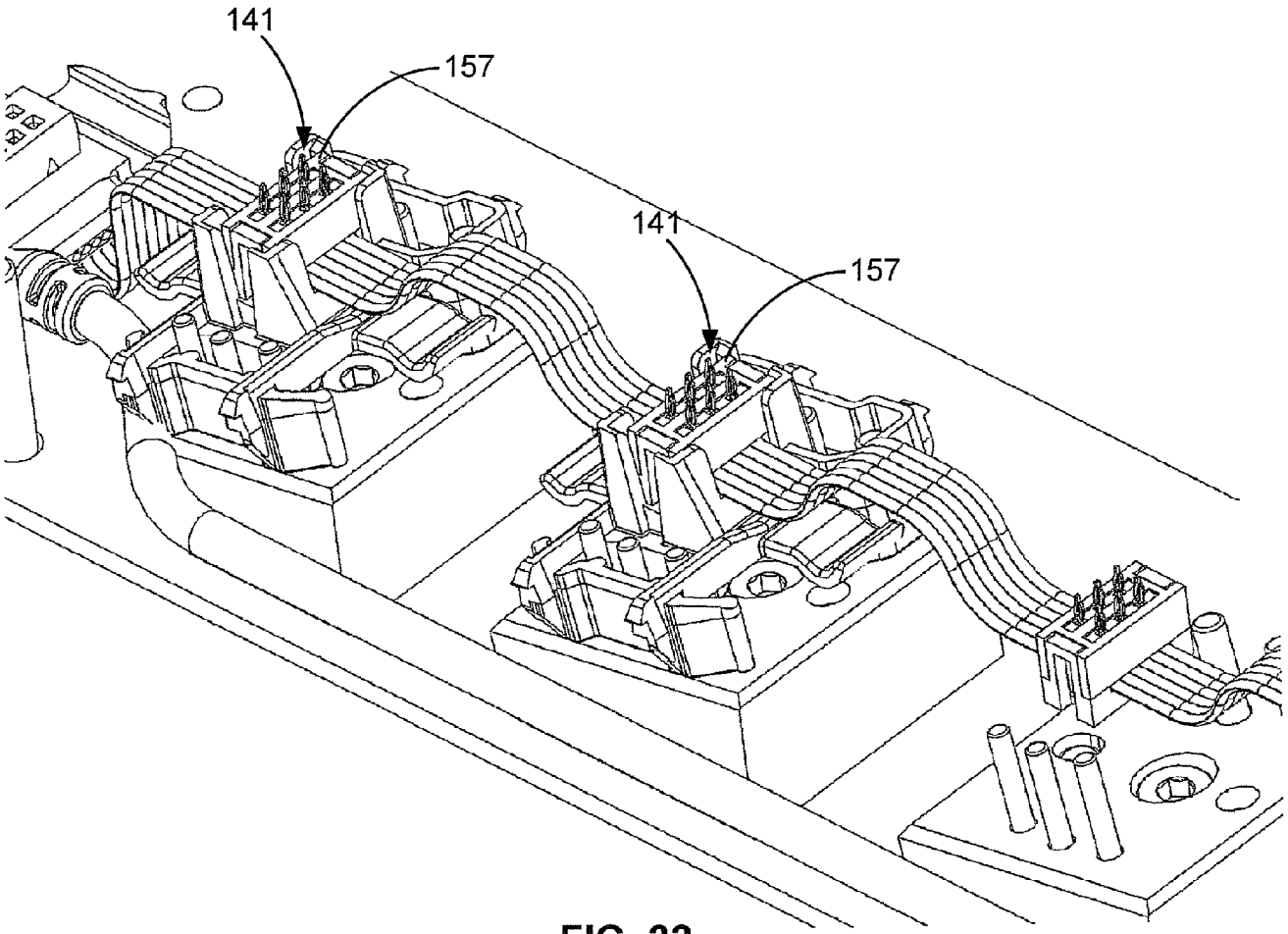
FIG. 22 is a perspective view of electrical connectors on a ribbon cable seated in the retainer clip housing section of FIG. 21.
Figure 23:
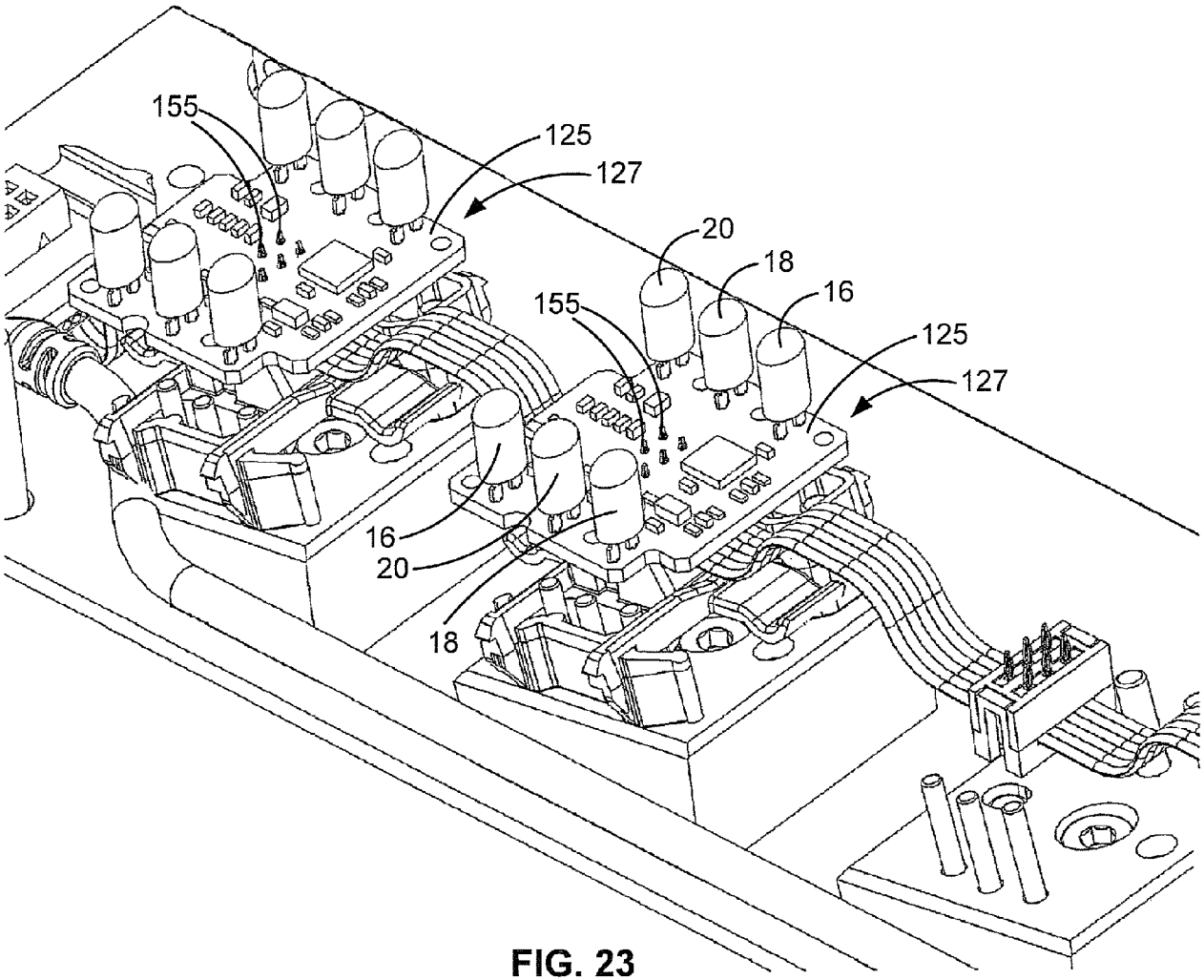
FIG. 23 is a perspective view of a printed circuit assembly mounted on the electrical connector and retainer clip housing section of FIG. 22.
Figure 24:
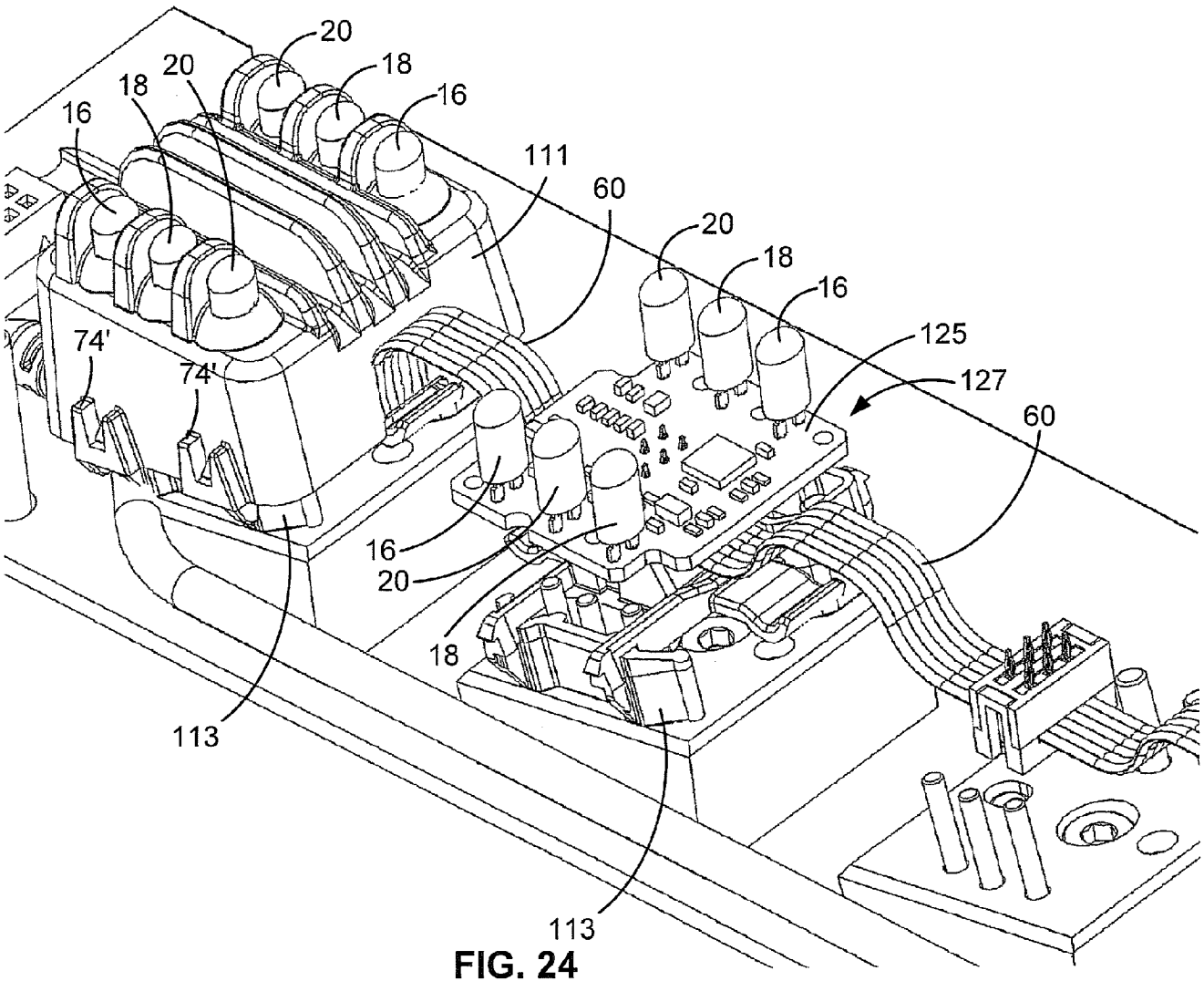
FIG. 24 is a perspective view of a top housing section mounted over the printed circuit assembly and onto the retainer clip housing section of FIG. 23.

A slave LED module segment is assembled using a press fixture 161 shown in FIGS. 20-24. During assembly, the retainer clips 113 for the slave LED modules of a segment are first placed on individual supports 167 of a bottom, slidable section 163 of the press fixture 161 by sliding a retainer clip 113 over locating pins 165 that extend upwardly from the support 167. Next, the electrical connectors 151 are placed in the seats 141 of the retainer clips 113 for the LED modules of a segment with the ribbon cable 60 extending through the openings between the seat walls as shown in FIG. 22. Thereafter, as shown in FIG. 23, the printed circuit assembly 127 is placed on top of the electrical connectors 151 so that the top of the compliant connector pins 155 extends into the respective pin holes of the printed circuit assembly board such that the board 125 rests on top of the compressible portions of the compliant connector pins 155. Thereafter, the bottom section 163 of the press fixture 161 is slid below the pneumatic cylinders 171 of the press fixture 171. A sensor detects when the bottom section 163 is in place under the pneumatic cylinders 171 and in response to the sensor detecting the proper positioning of the bottom section, the press fixture 161 actuates a group of pneumatic cylinders at one time to press a respective group of printed circuit assembly boards into their home positions against the top surface of the walls 143, 145, 147 and 149 of the seat 141 such that the compliant connector pins 155 are compressed and extend through the pin holes of the printed circuit assembly board as shown in FIG. 23. In a preferred embodiment every third pneumatic cylinder is actuated as a group. Once the first group of cylinder has completed the mounting of the board 125 on connector 151, the next group of cylinders is actuated and so on until all of the boards 125 for the LED module segment have been mounted. Thereafter, the bottom section 163 of the press fixture 161 is slid out from underneath the cylinders 171 to the location depicted in FIG. 20. The top housing sections 111 of the slave LED modules are then snapped onto respective retainer clips 113. After the top housing sections 111 are snapped onto the retainer clips 113 of a segment of slave LED modules, all of the electrical connections of the modules are tested. Next, the segment of slave LED modules undergoes a potting process. For potting, a two-part resin, such as CONATHANE DPEN-29291, is used wherein the potting material is dispensed into the two ports/wells 137 and 139 to evenly fill the housing such that the printed circuit assembly 127 and the connections with the connector 151 are encapsulated and sealed within the module housing. It is noted, that the mounting of the printed circuit assembly 127 on the connector pins 158 so that the printed circuit assembly board 125 is centrally supported by the top surface of the seat 141 allows the printed circuit assembly 127 to "float" within the LED module housing to ensure that the electrical components and connections of the printed circuit assembly are encapsulated by the potting material to seal these components from the environment.

The housing 124 for each of the master LED modules is over-molded about the master module printed circuit boards 126 and 128. The LEDs 16, 18 and 20 for the master module 12 are mounted on the printed circuit board 126 which is similar to the printed circuit board 102 of the slave LED modules for controlling the illumination of the LEDs of a module. The printed circuit board 128 of the master LED module includes additional circuitry for controlling the functions of the master LED module that are unique thereto, such as extracting the data intended for the master module and its associated slave LED modules in a segment 24 of the display as described in the co-pending patent application Ser. No. 12/001,227, entitled "Data and Power Distribution System And Method For A Large Scale Display," filed concurrently herewith and incorporated herein by reference. In a preferred embodiment, the printed circuit board 126 is soldered to the circuit board 128 at a 10° angle so that when the boards 126 and 128 are placed in the mold for the master LED module housing 124, the LEDs 16, 18 and 20 will be at a 10° angle to the back surface 130 of the module 12 as described above for the LEDs of the slave module 14.

The front surface of the housing 124 for each of the master LED modules 12 is the same as the front surface of the housing 100 for the slave LED modules 110 so that both types of modules have the same LED order, the same heat sink fins 108 and the same sunshades 110, providing a uniform appearance of pixels throughout the display regardless of whether they are generated by a master or a slave module. However, the sides and the back surface 130 of the master LED module housing 124 are different than those of the housing 100 for the slave modules 102. In particular, the sides 129 and 131 of the master module housing 124 are formed with projections 132 having apertures 134 therein for the screws 78 that attach the master LED module 12 to the back plate 42 of the master LED module. The back surface 130 of the master LED module housing 124 includes a number of integrally formed heat sinks 136 so as to further aid in the heat dissipation of the master module. It is noted that the housings for the master LED modules are over-molded with a thermally conductive resin. The resin conducts heat away from components and the geometry of the housing spreads the heat and provides a maximized surface area for heat transfer. Moreover, the back plate 42 is thermally and electrically connected to the ground plane on the master LED module's printed circuit board to allow the back plate 42 to act as an additional and independent heat sink for the master LED module.

The back surface 130 of the housing 124 of the master LED module 12 is also formed with two pairs of grooves 138 and 140 through which power cable connectors 142 and 144 extend. When power cables 118 and 120 are seated in the grooves 138 and 140 of the housing 124, the prongs of the connectors 142 and 144, pierce the rubber insulation of the power cables so as to make electrical contact with the cables. The power cables are continuous and the insulation piercing connectors 142 and 144 are formed with sharp prongs to minimize the force required to penetrate the rubber insulation on the cables. The preferred insulation is a thermoplastic elastomer because of its resilience and toughness. This insulation tends to close around the penetrating prongs forming a seal. It is noted that when the screws 78 that attach a master LED module 12 to a back plate 42 are tightened, the prongs of the connectors 142 and 143 are driven into the power cables. A redundant set of power connections are provided for the master LED modules so that there are two positive and two neutral connections spread apart as far as possible such that the system is tolerant to a connection failure. The master LED module 12 also includes Z-axis connectors 148 and 150 surrounded by elastomeric pads 152 although other types of connectors may be used. The Z-axis connectors are commercially available flexible connectors that are designed to conduct along a single Z-axis. The back plate 42 compresses the Z-axis connector between contacts on the printed circuit board 128 and contacts on the flex circuit 90. The flex circuit 90 is designed as a stripline circuit with conductors and conductor spacing adjusted to achieve the desired impedance (75 ohms). The stripline configuration also provides shielding for the data conductors. The Z-axis connectors connect to the flex cables 90 so as to allow adjacent master LED modules 12 in a row of a display panel to communicate directly as discussed above.

As noted above, in accordance with a preferred embodiment of the present invention, the display 10 is arranged in a number of panels for easy deployment. Each panel, may have, for example, sixteen columns wherein a full height panel has 480 rows, although, each of the display panels can have any height and width desired. The support cables, 24, 26, 30, 32, 36 and 40 for the LED modules of each display panel are attached to a steel bar 60 by clamps wherein each of the steel bars 160 of a display 10 are connected together to support the multiple display panels forming the display 10. The steel bar 160 is then attached to a support structure 162 which is used to hoist the display 10 on to a support structure such as a building or frame. Each of the display panels forming the display 10 includes a data hub 164 that provides the video data to the display panel of the display 10. Power to the display panel 10 may also be provided to the display 10 through the data hubs 164 so that the data hubs can monitor the power supply. Details of the data hubs and power hubs for the display 10 are disclosed in the co-pending patent application Ser. No. 12/001,277, entitled "Data and Power Distribution System and Method For A Large Scale Display," filed concurrently herewith and incorporated herein by reference.

The large scale LED display of the present invention is extremely robust, readily repairable and suitable for outdoor as well as indoor use. Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A display, comprising:

a plurality of LED display panels, each display panel including a plurality of LED modules mounted in a plurality of rows on a support structure including a plurality of parallel cables and h-links, wherein an LED module is spaced from an adjacent LED module in a row by a h-link mounted on a pair of adjacent cables; and a plurality of seam links, each seam link having a first end for snapping on a cable on the edge of one LED display panel and a second end for snapping on a cable on the edge of an adjacent LED display panel to connect the LED display panels together.

2. The display according to claim 1, wherein a cable on the edge of the display panel includes a plurality of link engagement members disposed along the length of the cable, each link engagement member being aligned with a row of LED modules, wherein the seam links snap onto a link engagement member.

3. The display according to claim 1, wherein the h-links in a row of LED display modules of the display panels are aligned and the seam link connecting the LED display panels together is aligned with the h-links in the row of LED display modules.

4. The display according to claim 3, wherein the number of seam links connecting two LED display panels together is less than the number of rows of LED display modules in the display panel.

5. The display according to claim 1, wherein the seam links provide approximately the same spacing between an LED module in one LED display panel and an adjacent LED module in a connected LED display panel as the spacing provided by the h-link between a pair of adjacent LED modules in one LED display panel.

6. The display according to claim 1, wherein each of the seam links has a cross bar extending between the first and second ends that snap on a cable, wherein the width of the cross bar is less than the width of the first and second ends.

7. A display, comprising:

a plurality of LED display panels, each display panel including at least one column of LED modules mounted on a pair of parallel cables; and a plurality of seam links, each seam link having a first end for snapping on a cable of one LED display panel and having a second end for snapping on a cable of another LED display panel to connect the LED display panels together.

8. The display according to claim 7, wherein each of the seam links has a cross bar extending between the first and second ends that snap on a cable, and wherein the width of the cross bar is less than the width of the first and second ends.

9. A display, comprising:

a plurality of LED display panels, each display panel including at least one column of LED modules mounted on a pair of parallel cables, wherein at least one cable of each display panel has a plurality of link engagement members disposed along the length of the cable; and a plurality of seam links, each seam link having a first end for snapping on a link engagement member on a cable of one LED display panel and having a second end for snapping on a link engagement member on a cable of another LED display panel.

10. The display according to claim 9, wherein each of the link engagement members is a substantially cylindrical member molded onto the cable.

11. The display according to claim 9, wherein a LED module is mounted on a cable adjacent to the link engagement member.

12. The display according to claim 9, wherein each of the link engagement members locates a mounting position for a LED module on the cable.

13. The display according to claim 9, wherein each of the seam links has a cross bar extending between the first and second ends that snap on a link engagement member, and wherein the width of the cross bar is less than the width of the first and second ends.

14. A display, comprising:

a plurality of LED display panels, each display panel including a plurality of LED modules mounted in a plurality of rows on a support structure that includes a plurality of parallel cables and h-links, wherein an LED module is spaced from an adjacent LED module in a row by a h-link, wherein the h-links in a row are aligned; and a plurality of seam links, each seam link having a first end for snapping on cable on the edge of one LED display panel and a second end for snapping on a cable on the edge of an adjacent LED display panel to connect the LED display panels together, wherein a seam link is aligned with the h-links in a row.

15. The display according to claim 14, wherein a cable on the edge of the display panel includes a plurality of link engagement members disposed along the length of the cable, wherein each link engagement member is aligned with a row of LED modules, and wherein the seam links snap onto a link engagement member.

16. The display according to claim 15, wherein the number of seam links connecting two LED display panels together is less than the number of rows of LED modules in a LED display panel.

17. The display according to claim 15, wherein the seam links provide approximately the same spacing between an LED module in one LED display panel and an adjacent LED module in a connected LED display panel as the spacing provided by the h-link between a pair of adjacent LED modules in one display panel.

18. The display according to claim 15, wherein each of the seam links has a cross bar extending between the first and second ends that snap on a cable, and wherein the width of the cross bar is less than the width of the first and second ends.

19. The display according to claim 14, wherein the LED module or the adjacent LED module is one of a slave LED module and a master slave LED module.

20. The display according to claim 19, wherein the master LED module is configured differently from the slave LED, module, and wherein each master LED module and the slave LED module has respective LEDs.

* * * * *